US007377506B2

(12) United States Patent
Miyajima

(10) Patent No.: US 7,377,506 B2
(45) Date of Patent: May 27, 2008

(54) IMAGE FORMING APPARATUS AND CONTROL METHOD THEREFOR

(75) Inventor: Jun Miyajima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 557 days.

(21) Appl. No.: 10/765,400

(22) Filed: Jan. 28, 2004

(65) Prior Publication Data

US 2004/0184058 A1 Sep. 23, 2004

(30) Foreign Application Priority Data

Feb. 3, 2003 (JP) ..... 2003-026299

(51) Int. Cl.
*B65H 3/44* (2006.01)

(52) U.S. Cl. ..... 271/9.03; 271/9.05; 399/23; 399/391

(58) Field of Classification Search ..... 271/2.01–9.06; 399/23, 389, 391
See application file for complete search history.

(56) References Cited

U.S. PATENT DOCUMENTS

| | | | | |
|---|---|---|---|---|
| 4,484,734 | A * | 11/1984 | Tsudaka et al. | 271/9.03 |
| 4,763,889 | A * | 8/1988 | Dei et al. | 271/9.03 |
| 5,267,727 | A * | 12/1993 | DeHority | 270/1.02 |
| 5,722,029 | A * | 2/1998 | Tomidokoro et al. | 399/389 |
| 5,848,320 | A * | 12/1998 | Yaginuma et al. | 399/45 |
| 6,539,198 | B2 | 3/2003 | Miyajima | 399/389 |
| 2002/0051666 | A1 | 5/2002 | Asai et al. | 399/391 |

FOREIGN PATENT DOCUMENTS

| | | |
|---|---|---|
| JP | 8-73110 | 3/1996 |
| JP | 2000-128374 | 5/2000 |
| JP | 2001-278530 | 10/2001 |
| JP | 2002-3063 | 1/2002 |
| JP | 2002-40881 | 2/2002 |

OTHER PUBLICATIONS

Official Action/Search Report, issued Dec. 14, 2007, in Japanese Patent Application No. 2003-026299.

* cited by examiner

*Primary Examiner*—Patrick Mackey
*Assistant Examiner*—Jeremy R Severson
(74) *Attorney, Agent, or Firm*—Fitzpatrick, Cella, Harper & Scinto

(57) ABSTRACT

An image forming apparatus has a plurality of paper feed units setting index sheets. A storage section stores size information and index number information indicating the number of index sheets per set of paper sheet set in each paper feed unit, and a control section automatically changes the paper feed unit to be used from a first paper feed unit to a second paper feed unit and does not automatically change the paper feed unit to a third paper feed unit when the index sheets in the first paper feed unit are exhausted, the size information and the index number information of the first paper feed unit coinciding with those of the second paper feed unit and at least one of the size information and the index number information of the first paper feed unit not coinciding with those of the third paper feed unit.

6 Claims, 19 Drawing Sheets

IMAGE FORMING APPARATUS AND CONTROL METHOD THEREFOR

FIELD OF THE INVENTION

The present invention relates to an image forming apparatus which functions as a printing apparatus, such as a printer, copying apparatus, facsimile apparatus, or multifunction apparatus of them and, more particularly, to an image forming apparatus capable of selectively supplying a paper sheet from any one of a plurality of paper feed portions and printing on it, and a control method therefor.

BACKGROUND OF THE INVENTION

Widely spread image forming apparatuses such as a copying apparatus, printer, and facsimile apparatus have a paper storage portion (paper feed stage or paper feed portion) such as a cassette or tray which stores print sheets. Such image forming apparatus forms an image on a paper sheet supplied from the paper storage portion, and discharges the paper sheet outside the image forming apparatus. In order to form images on various paper sheets, some image forming apparatuses have a plurality of paper storage portions and can store paper sheets of various sizes and various types in the respective paper storage portions. At present, image forming apparatuses which store many paper sheets of a specific size by storing paper sheets of the same size in a plurality of paper feed stages, and form many images by one paper replenishment have become popular.

An image forming apparatus which stores paper sheets of the same size in a plurality of paper feed stages has an auto cassette change (hereinafter referred to as ACC) function of, when all paper sheets in a paper storage portion are consumed but paper sheets of the same paper size are stored in another paper storage portion, keeping feeding paper sheets from the substitute paper storage portion without stopping paper feed operation. Even if paper sheets in a given cassette run out, paper sheets in another cassette can be successively used. This shortens the operation stop time due to the absence of paper sheets, and increases the availability and productivity of the image forming apparatus (see Japanese Patent Laid-Open No. 2002-40881).

Japanese Patent Laid-Open No. 2002-40881 also discloses an image forming apparatus which considers the paper type in addition to the paper size. The image forming apparatus determines whether a paper storage portion storing paper sheets of the same size and same paper type as paper sheets which run out is available and, when no such paper storage portion, the auto cassette change for paper sheets which run out is not performed.

There is also proposed an image forming apparatus which stores paper sheets called index sheets (tabbed sheets) in the paper storage portion of the image forming apparatus, which may form images (see Japanese Patent Laid-Open No. 8-73110). As disclosed in Japanese Patent Laid-Open No. 8-73110, an index sheet (tabbed sheet) has an index (tab) added to a normal rectangular paper sheet. In general, index positions sequentially shift, the sheets overlap each other, and a plurality of index sheets form one set. The number of index sheets which form one set will be called a division number in this specification. Some image forming apparatuses which feed and deliver index sheets have a function of automatically discharging excessive index sheets out of a bundle of index sheets of one set from the paper storage portion outside the apparatus (see Japanese Patent Laid-Open No. 2002-3063).

A printed index sheet is set on a post-processing device called an inserter or collator in a copying apparatus or printer. The index sheet is inserted at a designated position of a printed or copied document, or manually inserted into a document. While a document is printed or copied on normal paper sheets, an index sheet may be conveyed to a designated insertion position from a paper storage portion which supports the index sheet, subjected to printing, and then merged into the printed or copied document.

When a paper storage portion whose paper size and paper type coincide with those of a paper storage portion which runs out of paper sheets is designated as the change destination of the ACC function, as disclosed in Japanese Patent Laid-Open No. 2002-40881, an image forming apparatus which feeds index sheets, as disclosed in Japanese Patent Laid-Open No. 2002-3063, performs auto cassette change even with a different index number (division number) of index sheets. Particularly, an index sheet is larger in width by the index than a normal paper sheet. Index sheets may not be stored in a normal paper feed stage, and can only be stored in a limited paper feed stage.

For example, in an image forming apparatus shown in FIG. 2, cassettes 311 and 312 are paper feed stages which can store many paper sheets but cannot store index sheets. Cassettes 313 and 314 are paper feed stages which can store a smaller number of paper sheets, compared to the cassette 311, but can store even index sheets. In this case, a user who uses many index sheets can store index sheets in both the cassettes 313 and 314, perform auto cassette change between index sheets, and use the index sheets. When, for example, the cassette 313 stores index sheets with an index number (division number) of 4 and the cassette 314 stores index sheets with an index number (division number) of 5, these index sheets are of originally different paper types, and auto cassette change between these cassettes is not intended by the user. In this case, it is preferable not to perform auto cassette change.

When index sheets with an index number of 4 are stored in both the cassettes 313 and 314, auto cassette change is preferably performed because of the same index number.

SUMMARY OF THE INVENTION

The present invention has been made in consideration of the above situation, and has as its object to provide an image forming apparatus which does not perform auto paper feed portion change when the coidentity of index sheets is not held before and after automatic paper feed portion change in printing on an index sheet, for example, when sizes, index numbers, or the shapes of index portions do not coincide with each other, and a control method therefor.

To achieve the above object, the present invention has the following arrangement.

According to the present invention, an image forming apparatus having a plurality of paper feed portions capable of setting index sheets, comprises a storage section which stores predetermined information on a paper sheet set in each paper feed portion; and a control section which performs processing of automatically changing the paper feed portion between the plurality of paper feed portions on the basis of the predetermined information stored in the storage section, wherein when index sheets are set in the plurality of paper feed portions and pieces of predetermined information on the index sheets set in the paper feed portions coincide with each other, said control section controls the paper feed portions so as to perform change processing between the plurality of paper feed portions in which index sheets are set, and when the pieces of predetermined information do not coincide with each other, controls the paper feed portions so as not to perform change processing.

According another aspect of the present invention, the predetermined information stored in said storage section preferably includes information on a size and a type of the paper sheet set in the paper feed portion, and when the paper type is an index sheet, information on the number of index portions and/or a shape of the index portion is further stored.

According another aspect of the present invention, the apparatus further comprises an index sheet setting section which sets the information on the number of index portions and/or the shape of the index portion.

According another aspect of the present invention, the image forming apparatus further comprises a paper feed portion change setting section which sets whether to automatically enable paper feed portion change processing for each of the plurality of paper feed portions, and when the paper feed portion change setting section performs a setting which permits paper feed portion change processing for the paper feed portions in which the index sheets are set, but the pieces of predetermined information on the index sheets set in the plurality of paper feed portions are determined not to coincide with each other, the control section controls the paper feed portions so as not to perform change processing.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

The whole configuration of an image input/output system according to an embodiment of the present invention will be described with reference to FIG. 1. The embodiment will exemplify a copying apparatus which can be utilized as a printer and scanner, i.e., a so-called multifunction apparatus. The present invention can also be applied to a printer, facsimile apparatus, or simple copying apparatus as far as the printing apparatus has a plurality of paper feed cassettes or paper feed trays.

<Arrangement of Image Forming Apparatus>

Figure 1:
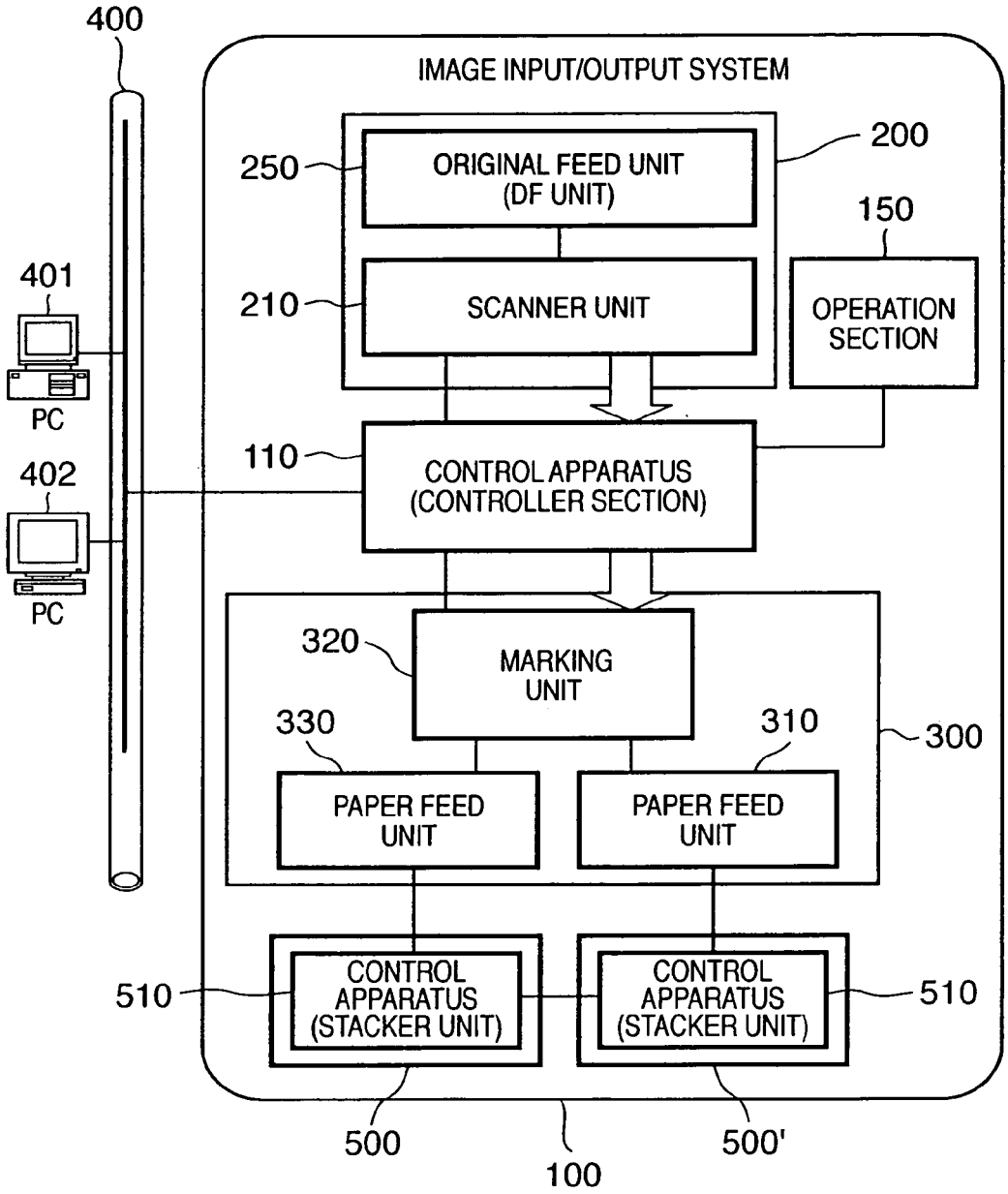
FIG. 1 is a view for explaining the whole configuration of an image input/output system according to an embodiment.

In FIG. 1, a reader section (image input apparatus) 200 optically reads an original image, and converts it into image data. The reader section 200 comprises a scanner unit 210 having a function of reading an original and an original feed unit 250 having a function of conveying an original sheet to the scanner unit 210.

A printer section (image forming apparatus) 300 conveys a print sheet, prints image data as a visible image on the print sheet, and delivers the print sheet outside the apparatus. The printer section 300 comprises a paper feed unit 310 having a plurality of types of print sheet cassettes, a marking unit 320 having a function of transferring and fixing image data onto a print sheet, and a delivery unit 330 having a function of outputting a printed print sheet outside the apparatus. In the embodiment, the whole multifunction apparatus will be called an image input/output system, and the printer section serving as an image forming function will be called an image forming apparatus. In this sense, the image forming apparatus is not limited to the multifunction apparatus of the embodiment, and is also incorporated in a facsimile apparatus, printer apparatus, or the like.

A control section (controller) 110 is electrically connected to the reader section 200 and printer section 300. The control section 110 is further connected to host computers 401 and 402 via a network 400.

The control section 110 controls the reader section 200 to load original image data, and controls the printer section 300 to form an image on a print sheet on the basis of image data, providing a copying function. The control section 110 also provides a scanner function of converting image data read by the reader section 200 into code data and transmitting the code data to a host computer via the network 400, and a printer function of converting code data (page description language: PDL) received from the host computer via the network 400 into image data and outputting the image data to the printer section 300.

The PDL defines a command representing a page break for each language. For example, the PDL defines a command "ShowPage" for PostScript available from Adobe Systems and a command "FormFeed" for PCL available from Hewlett-Packard. When such command is sent, the break of one page is first detected. There is also a method of determining the end of a job from time-out after interruption of data transfer from a host computer.

An operation section 150 is connected to the control section 110 and formed by a liquid crystal touch panel, and provides a user I/F for operating the image input/output system.

Figure 2:
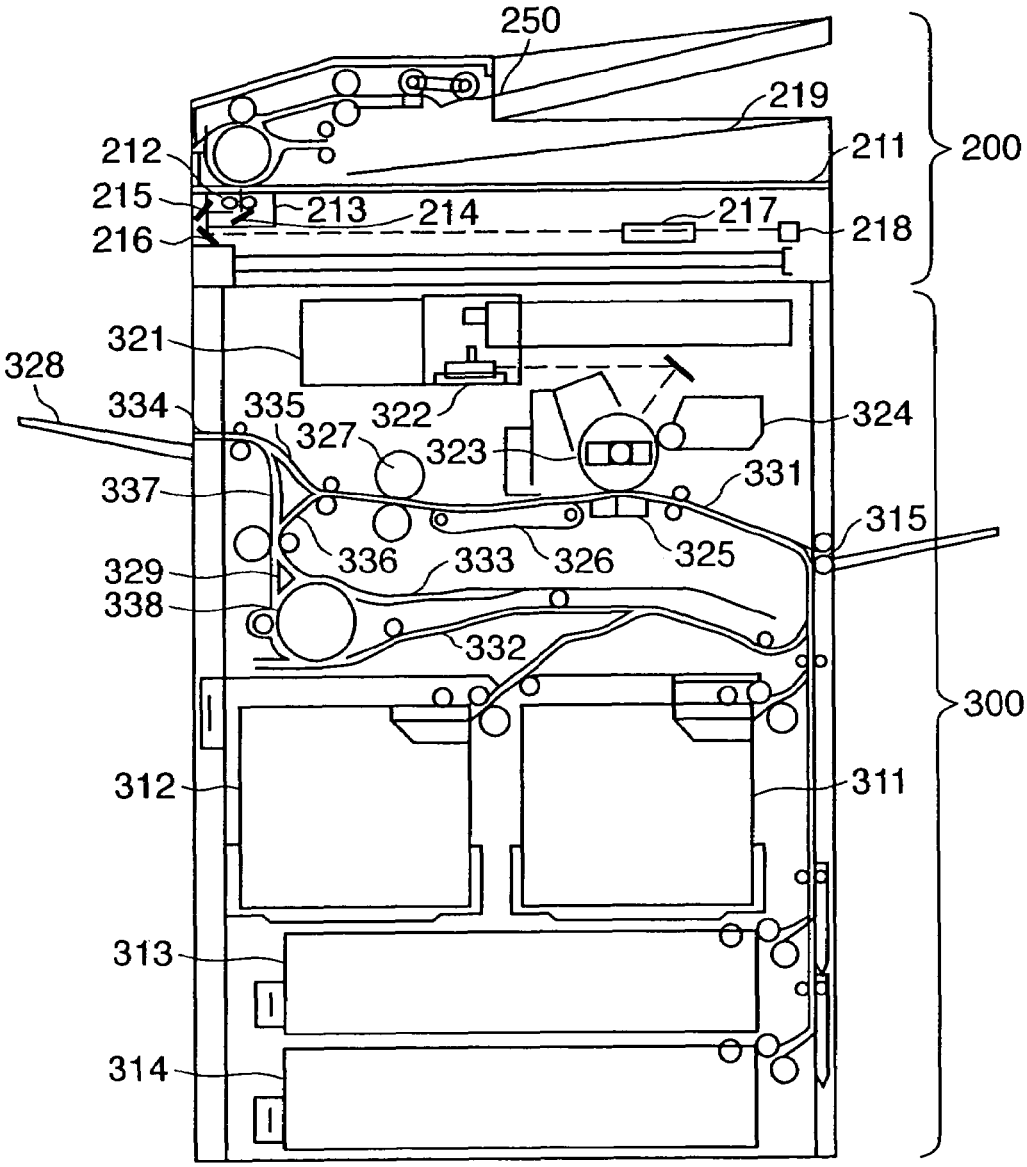
FIG. 2 is a sectional view showing a reader section and printer section.

FIG. 2 is a sectional view showing the reader section 200 and printer section 300. The original feed unit 250 of the reader section feeds original sheets one by one from the first page onto a platen glass 211. At the end of original reading operation, an original sheet on the platen glass 211 is discharged to a discharge tray 219. When an original sheet is conveyed onto the platen glass 211, a lamp 212 is turned on, and movement of an optical unit 213 starts to expose and scan the original sheet. Light reflected by the original sheet is guided to a CCD image sensor (to be referred to as a CCD hereinafter) 218 via mirrors 214, 215, and 216 and a lens 217. The scanned original image is read by the CCD 218. Image data output from the CCD 218 undergoes predetermined processing, and is transferred to the control section 110. The reader section 200 comprises of an original detection sensor (not shown), and detects the presence/absence of an original by the original detection sensor. The original detection sensor is formed by a sensor with a lever or an optical sensor.

Figure 5:
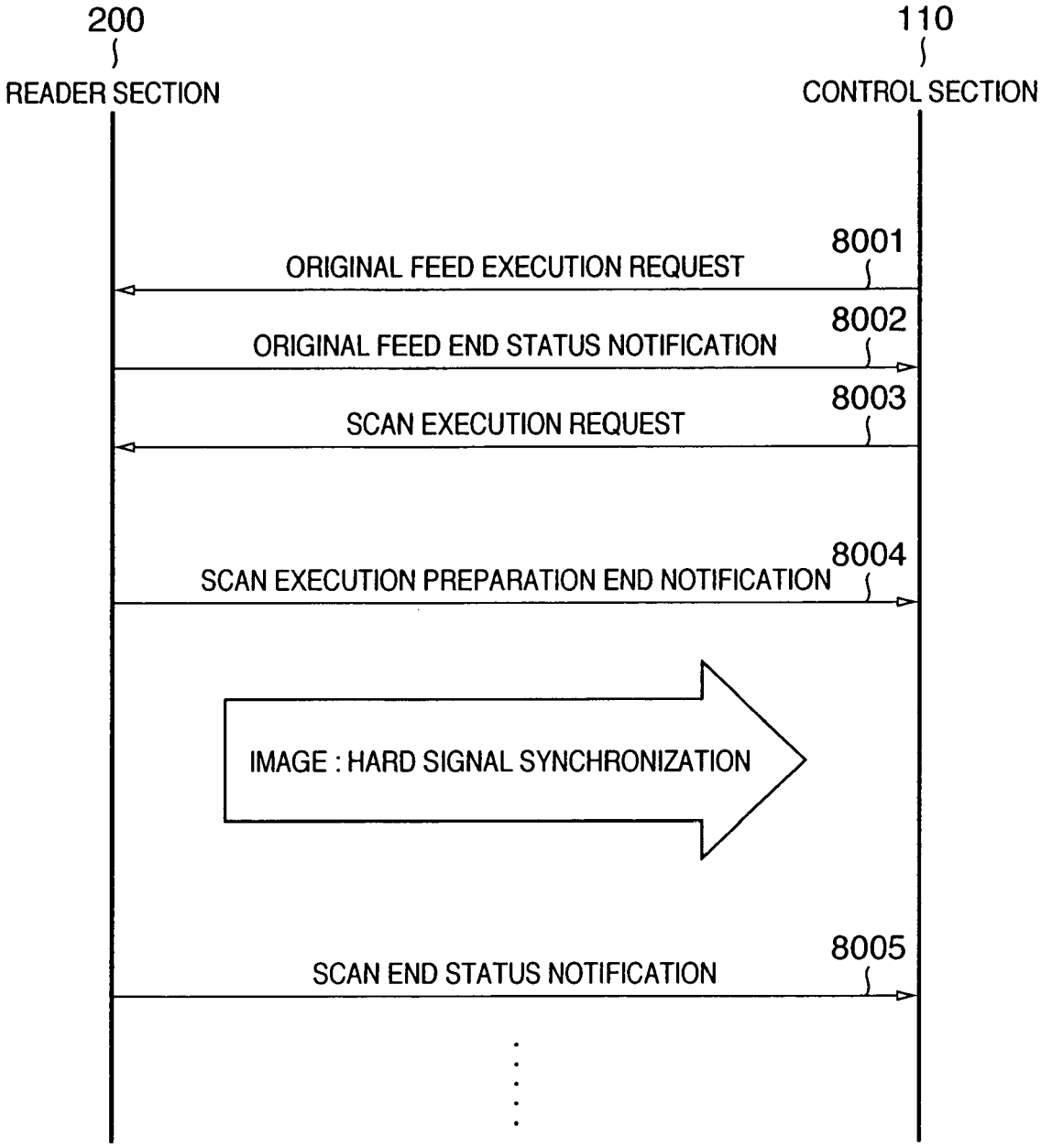
FIG. 5 is a chart showing a communication sequence between a control section 110 and a reader section 200.

The control section 110 and reader section 200 exchange commands shown in FIG. 5. The control section 110 issues "original feed execution request" (8001) to the reader section 200 in order to feed a set original. After the reader section 200 feeds an original in response to this, the reader section 200 issues "original feed end status notification" (8002) to the control section 110. At this time, the reader section 200 detects whether an original exists on the original detection sensor. If an original exists on the original detection sensor, the reader section 200 notifies the control section 110 of "next original exists"; otherwise, "no next original exists". That is, the presence/absence of an original is detected upon "original feed execution request" (8001), and the presence/absence of the next original is detected upon "original feed end status notification" (8002).

The control section 110 issues "scan execution request" (8003) to the reader section 200 to request reading of an original image. The reader section 200 notifies the control section 110 of "scan execution preparation end notification" (8004) at the start of actual image reading, and "scan end status notification" (8005) at the end of image reading.

A laser driver 321 of the printer section 300 drives a laser emission portion 322. The laser driver 321 causes the laser emission portion 322 to emit a laser beam corresponding to image data output from the control section 110. The laser beam irradiates a photosensitive drum 323, and a latent image corresponding to the laser beam is formed on the photosensitive drum 323. A developer mix from a developing unit 324 is attracted to the latent image portion of the photosensitive drum 323.

As paper storage portions, the printer section comprises pullout cassettes 311, 312, 313, and 314, and a manual paper feed portion 315 serving as a tray exposed outside the apparatus. In general, a cassette except the manual paper feed portion 315 is pulled out, replenished with paper sheets, and closed, thereby replenishing, storing, and setting paper sheets.

Figure 7:
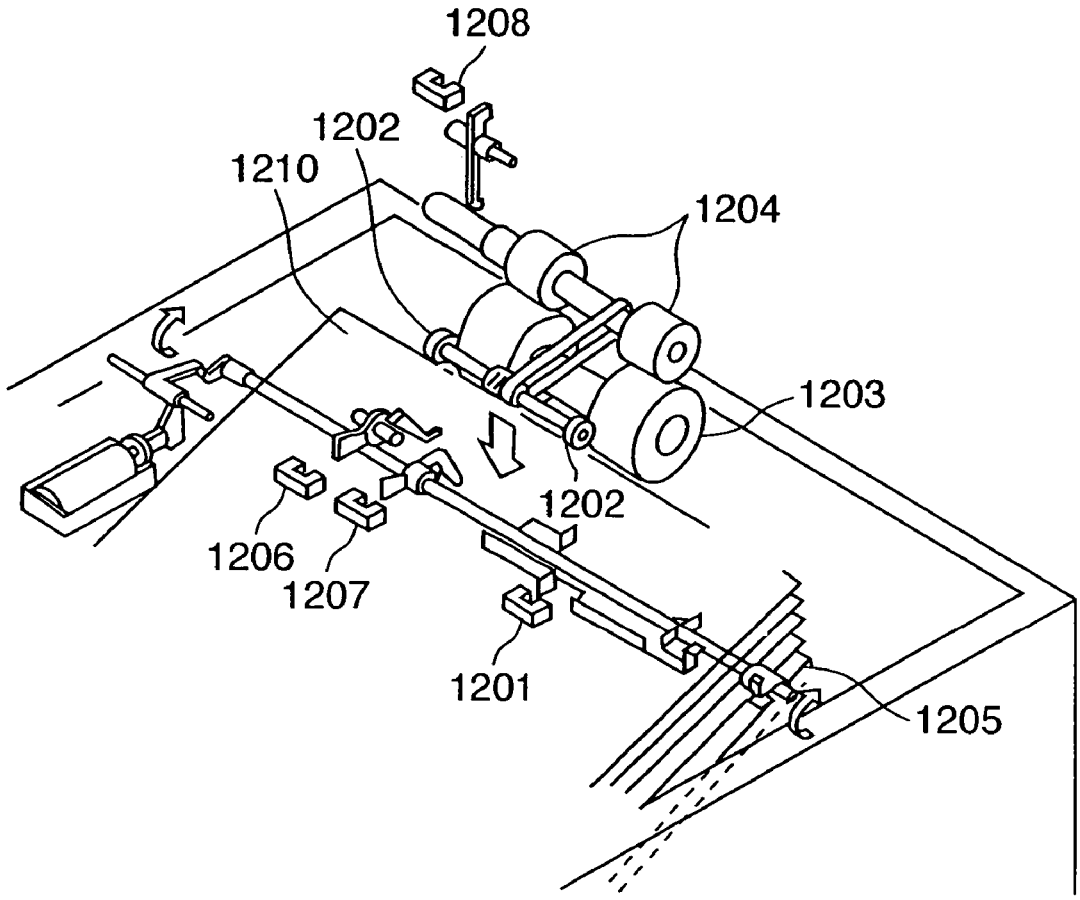
FIG. 7 is a view for explaining paper storage portions 311, 312, 313, and 314.

FIG. 7 is a view showing the paper feed mechanism of the cassette 311. The paper storage cassette 311 comprises a cassette opening/closing sensor 1201 which detects the open/closed state of the cassette, a paper feed roller 1202 for feeding a paper sheet, a separation roller 1203 which separates a paper sheet so as not to feed a plurality of paper sheets, a convey roller 1204 which conveys a separated paper sheet to a convey path, a paper feed sensor 1208 which detects whether paper feed is successful, a lifter 1205 which lifts a paper sheet, a lift position detection sensor 1206 which detects a lift-up position, and a paper detection sensor 1207 which detects whether a paper sheet exists. If the paper detection sensor 1207 detects "no paper sheet exists" in each cassette, the detected state is transmitted to the control section 110, which will be described later.

Similar to the cassette 311, the paper storage portions, i.e., the cassettes 312, 313, and 314 and the manual paper feed portion 315 have the arrangement shown in FIG. 7. At the manual paper feed portion 315, the paper feed sensor 1208 and paper detection sensor 1207 can also be formed by one sensor. In the use of a size sensor, the control section 110 is notified of the size of paper sheets stored in each paper storage portion without any user designation.

At a timing synchronized with the start of laser beam irradiation (i.e., a timing uniquely determined using the laser beam irradiation start timing as a reference), a print sheet is sent to a transfer portion 325 via a convey path 331 from any one of the cassettes 311, 312, 313, and 314 and the manual paper feed stage 315. A developer mix deposited on the photosensitive drum 323 is transferred to the conveyed print sheet. The print sheet on which the developer mix is transferred is conveyed to a fixing portion 327 by a convey belt 326. The developer mix is fixed onto the print sheet by the heat and pressure of the fixing portion 327. The print sheet having passed through the fixing portion 327 is discharged onto a discharge tray 328 via convey paths 335 and 334. When the printed surface is reversed and the print sheet is discharged, the print sheet is guided to convey paths 336 and 338, then conveyed in an opposite direction, and conveyed via a convey path 337 and the convey path 334, thereby reversing the printed surface.

When double-sided printing is set, the print sheet having passed through the fixing portion 327 is guided from the convey path 336 to a convey path 333 by a flapper 329. The print sheet is conveyed in an opposite direction, and conveyed via the convey path 338 and a refeed convey path 332 by the flapper 329. The print sheet guided to the refeed convey path 332 passes through the convey path 331 at the above-mentioned timing, and is conveyed to the transfer portion 325. The print sheet discharged from the convey path 334 is stacked on the discharge tray 328.

Figure 6:
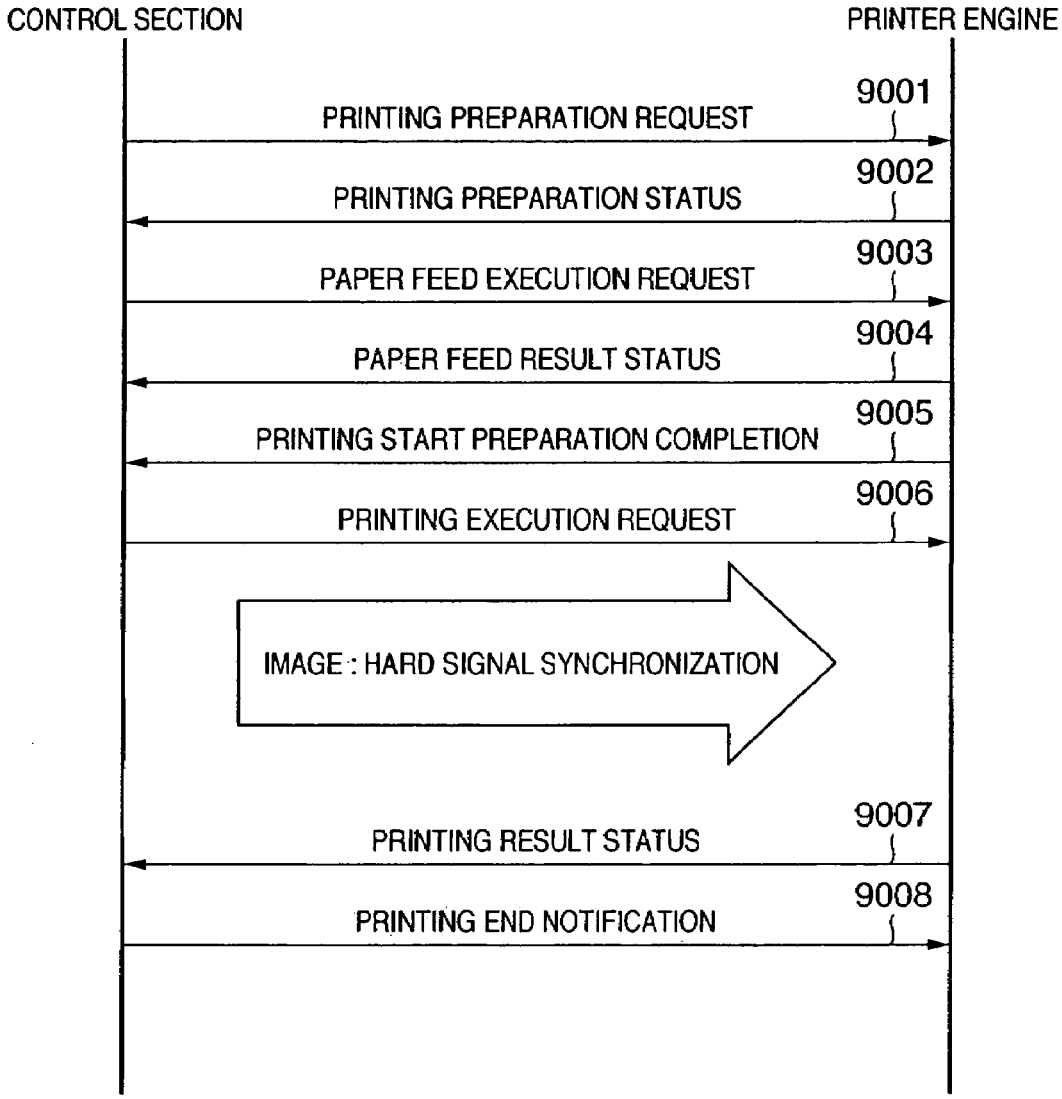
FIG. 6 is a chart showing a communication sequence between the control section 110 and a printer section 300.

FIG. 6 is a chart schematically showing communication between the control section (controller) 110 and the printer section (printer engine) 300 shown in FIG. 1. These communication timings are merely an example, and the control section 110 and printer section 300 properly communicate with each other so as to practice the present invention.

To print one page, the control section 110 issues a printing preparation request 9001 to the printer section 300. The printer section 300 which has received the printing preparation request starts pre-printing processing such as temperature control of the fixing unit or cleaning. Upon the completion of pre-printing processing, the printer section 300 issues a printing preparation status 9002 representing the completion of pre-printing processing to the control section 110.

To request feed of a paper sheet, the control section 110 which has received the printing preparation status 9002 issues a printing execution request 9003 to the printer section 300. At this time, the control section 110 notifies the printer section 300 which of the cassettes 311, 312, 313, and 314 and the manual paper feed portion 315 feeds a paper sheet, or when the apparatus has a plurality of discharge trays (not shown in the embodiment), which of the discharge trays receives a discharged paper sheet.

The printer section 300 which has received the printing execution request 9003 starts feeding a paper sheet. After the trailing end of a fed paper sheet is detected by a sensor (sensor corresponding to the paper feed sensor 1208 in FIG. 7) mounted at a paper storage portion which feeds the paper sheet, the printer section 300 issues a paper feed result status 9004 to the control section 110. When an error such as the absence of a paper sheet occurs, the printer section 300 notifies the control section 110 of the error by the paper feed result status 9004.

When the paper sheet reaches a predetermined position, the printer section 300 which has fed the paper sheet issues printing start permission (printing start preparation completion 9005). When an image becomes actually formable, the control section 110 which has received the printing start permission (printing start preparation completion 9005) from the printer section 300 issues a printing execution request 9006 to the printer section 300, thereby requesting formation and fixing of the image. After that, hard signal synchronization of image data is performed between the control section 110 and the printer section 300 (the control section 110 transmits image data to the printer section 300 in synchronism with a pixel clock signal transmitted from the printer section 300 to the control section 110), thereby forming and fixing the image.

The printer section 300 issues a printing result status 9007 to the control section 110 for single-sided printing at a timing when the paper sheet bearing the image is discharged outside the apparatus after fixing and stacked on the discharge tray 328 designated by the printing execution request 9003, or for double-sided printing at a timing when single-sided printing is completed.

When the paper sheet is discharged outside the discharge tray 328 and no subsequent output image exists, the control section 110 issues a printing end notification 9008 to the printer section 300, and if necessary, requests the printer section 300 to execute post-printing processing (stapling, sorting, or the like).

The operation section 150 will be explained with reference to FIG. 3.

An LCD touch panel 600 allows performing main mode setting operation, status display, and the like. Various settings of an index sheet (to be described later) are also done on the touch panel 600. A ten-key pad 601 is used to input numerical values of 0 to 9. An ID key 602 is used to input a department number and password code when use limitations based on the department number are posed on the apparatus.

A reset key 603 is used to reset a set mode. A guide key 604 is used to display an explanatory window for each mode. A user mode key 605 is used to enter a user mode window. An interrupt key 606 is used to perform interrupt operation.

A start key 607 is used to start operation. A stop key 608 is used to stop a job in progress.

When a soft power switch 609 is pressed, the backlight of the LCD 600 is turned out, and the apparatus shifts to a low-power state. When a power saving key 610 is pressed, the apparatus shifts to a power saving state, and when the key 610 is pressed again, returns from the power saving state.

Function keys 611 and 612 are function switching keys for shifting to a copying function and box function. In FIG. 3, the standard window of the copying function is displayed. By pressing the key 612, the standard window of each function is displayed.

An adjustment key 614 is used to adjust the contrast of the LCD touch panel 600.

By pressing a counter confirmation key 615, a count window which displays the count of copied sheets used is displayed on the LCD 600.

An LED 616 represents printing in execution and image accumulation in the image memory (not shown) of the apparatus. An error LED 617 represents the error state of the apparatus such as a jam or a door open state. A power LED 618 represents that the main switch (not shown) of the apparatus is ON.

<Description of Control Section>

Figure 4:
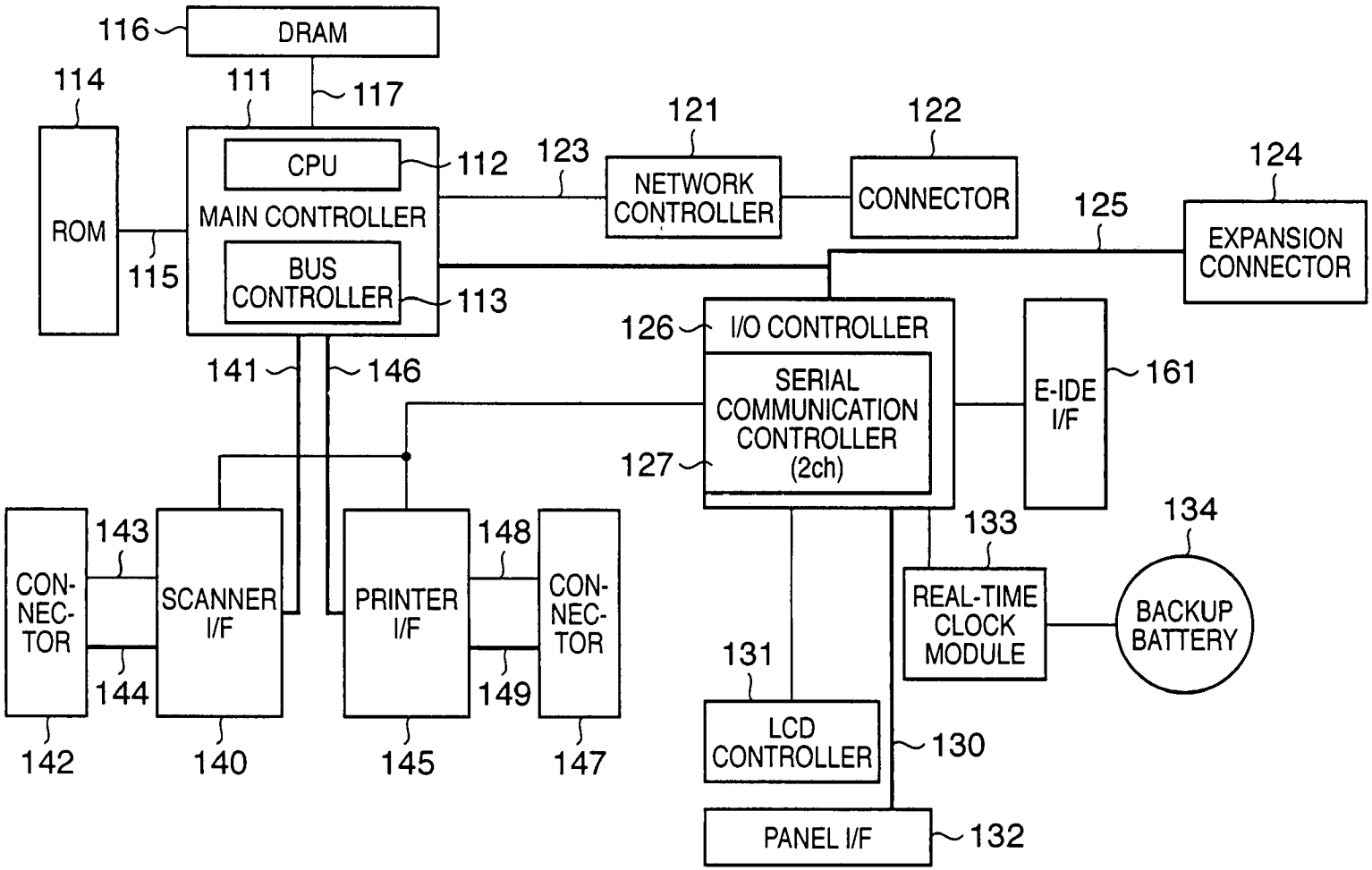
FIG. 4 is a block diagram showing a control section.

The functions of the control section 110 will be described with reference to the block diagram shown in FIG. 4. The control section 110 to be described later has an illustrative arrangement for explaining the embodiment, and can take any proper arrangement so as to practice the present invention.

A main controller 111 is mainly comprised of a CPU 112, a bus controller 113, and various I/F controller circuits.

The CPU 112 and bus controller 113 control the entire operation of the control section 110. The CPU 112 is a processor for executing a program or the like loaded from a ROM 114 via a ROM I/F 115. Operation of interpreting PDL (Page Description Language) code data received from a host computer and expanding the data into raster image data is also described in a program stored in the ROM 114. Such data is processed by executing this program. The bus controller 113 controls transfer of data input/output to/from each I/F. The bus controller 113 arbitrates contention of data transfer, and controls DMA data transfer.

A DRAM 116 is connected to the main controller 111 via a DRAM I/F 117. The DRAM 116 is used as a work area for various programs to be processed by the CPU 112, and as an area for accumulating image data.

A network controller 121 is connected to the main controller 111 via an I/F 123. The network controller 121 is connected to an external network via a connector 122, and controls data exchange with the external network. A general example of the external network is an Ethernet®.

A general-purpose high-speed bus 125 is connected to an expansion connector 124 for connecting an expansion board, and an I/O controller 126. A general example of the general-purpose high-speed bus is a PCI bus.

The I/O controller 126 is equipped for two channels with a start-stop synchronous serial communication controller 127 for exchanging control commands with each CPU arranged in the printer section 300. The serial communication controller 127 is connected to external I/F circuits 140 and 145 via an I/O bus 128.

A panel I/F 132 is connected to an LCD controller 131. The panel I/F 132 is formed by an I/F for display on the LCD touch panel 600 of the operation section 150, and a key input/output I/F 130 for controlling input/output of hard keys and touch panel keys.

A signal input from the touch panel or hard key of the operation section 150 is transmitted to the CPU 112 via the panel I/F 132. The LCD touch panel 600 displays image data sent from a panel I/F 520.

A real-time clock module 133 is used to update and save a date and time managed in the apparatus. The real-time clock module 133 is backed up by a backup battery 134.

An E-IDE interface 161 is used to connect an external memory device. A hard disk drive, CD-ROM drive, or the like is connected via this I/F to allow writing and loading programs and image data.

Connectors 142 and 147 are respectively connected to the reader section 200 and printer section 300. The connectors 142 and 147 are formed by start-stop synchronous serial I/Fs (143 and 148) and video I/Fs (144 and 149).

The scanner I/F 140 is connected to the reader section 200 via the connector 142 and to the main controller 111 via a scanner bus 141. The scanner I/F 140 has a function of, among others, optimizing an image received from the reader section 200 in accordance with the contents of processing in a subsequent process. The scanner I/F 140 also has a function of outputting to the main controller 111 via the scanner bus 141 a control signal generated on the basis of a video control signal sent from the reader section 200.

Data transfer from the scanner bus 141 to the DRAM 116 is controlled by the bus controller 113.

The printer I/F 145 is connected to the printer section 300 via the connector 147 and to the main controller 111 via a printer bus 146. The printer I/F 145 has a function of performing smoothing processing for image data output from the main controller 111 and outputting the resultant data to the printer section 300. The printer I/F 145 also has a function of outputting to the main controller 111 via the printer bus 146 a control signal generated on the basis of a video control signal sent from the printer section 300.

Transfer of raster image data expanded in the DRAM 116 to the printer section 300 is controlled by the bus controller 113. The expanded data is DMA-transferred to the printer section 300 via the printer bus 146 and video I/F 149.

<User Operation and Corresponding Operation>

A means for setting whether to enable automatic paper feed portion change for each paper feed portion in the image forming apparatus according to the present invention, a means for setting a paper type for each paper feed portion, and a means for setting an index number when the paper type is an index sheet will be explained with reference to FIGS. 8 to 18.

(Selection of User Mode)

Figure 3:
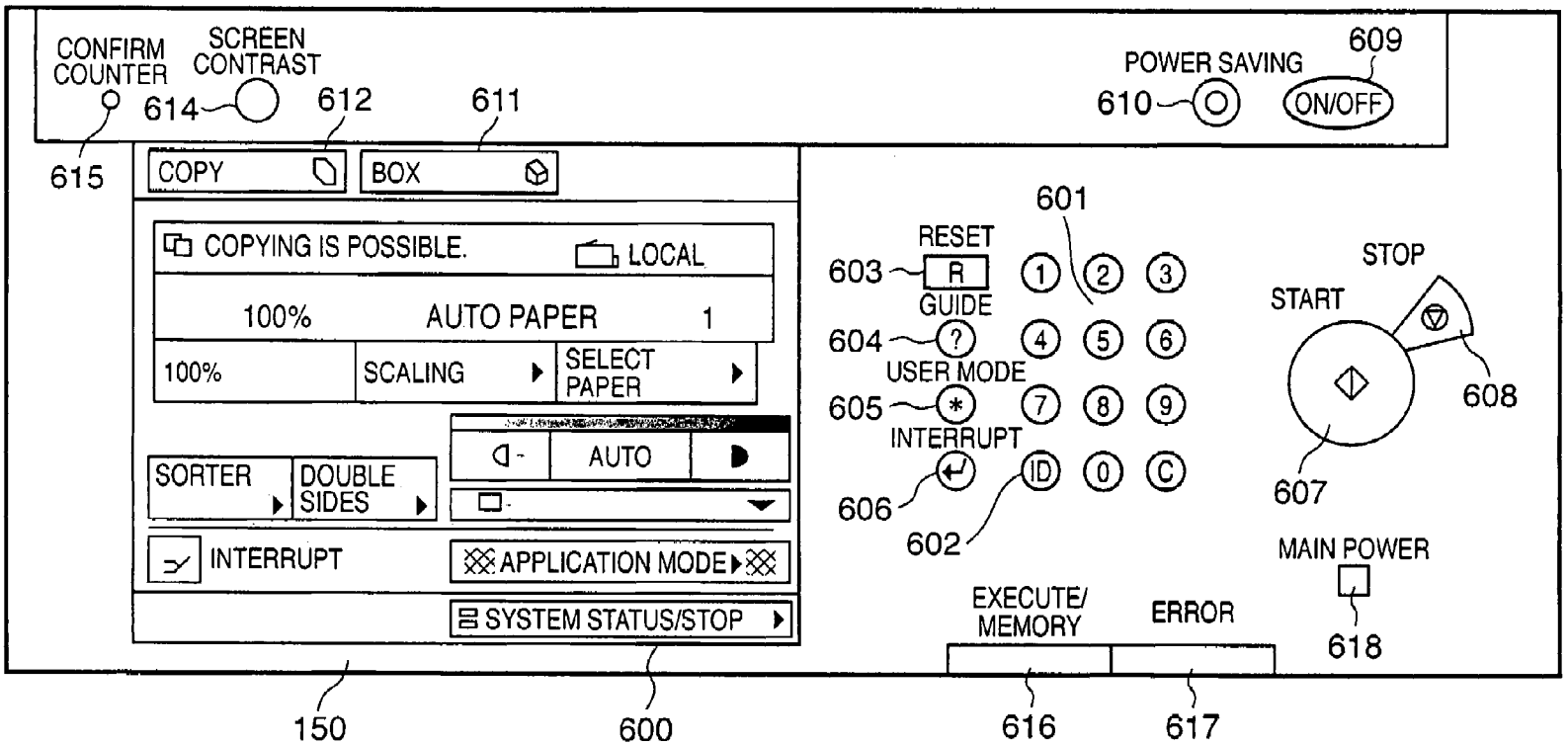
FIG. 3 is a view showing an operation section.
Figure 8:
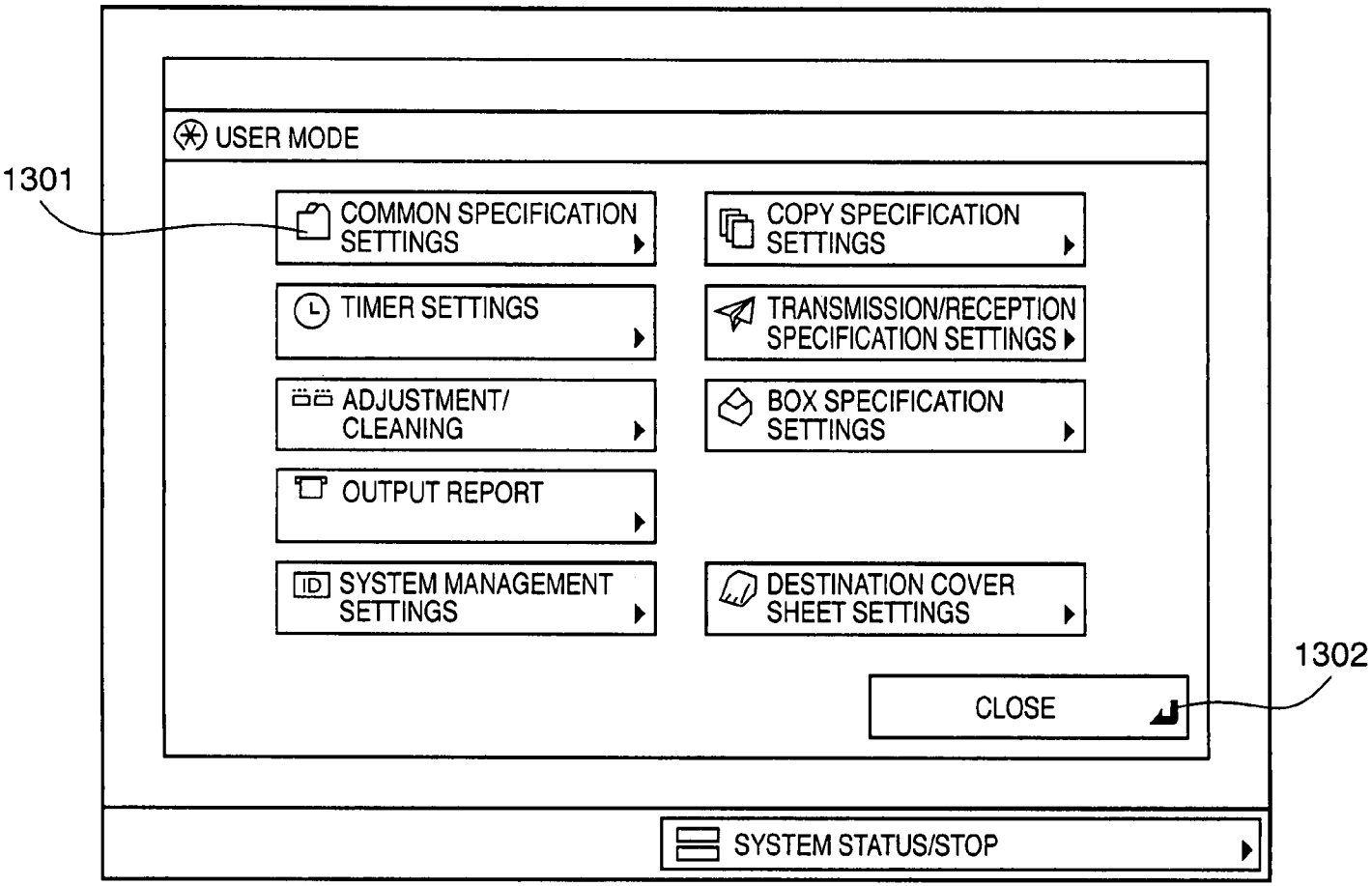
FIG. 8 is a view showing a user mode window.

FIG. 8 is a view showing a window displayed on the liquid crystal screen of the operation section 150 when the user mode key 605 shown in FIG. 3 is pressed.

The user mode window has several selection buttons for various settings. For example, as for an item which must be set commonly between apparatuses, the user selects a common specification setting button 1301 to interactively perform setting. In addition, the user mode window includes a timer setting button for changing to a window having setting items for setting the time or the like when the apparatus shifts to the power saving mode, an adjustment/cleaning button for changing to a window having setting items and the like for adjusting a position such as a staple position, a report output button for changing to a window having setting items and the like for printing out an apparatus state, a system management setting button for changing to a window having items and the like for performing network settings, a copying use setting button for changing to a setting window having setting items and the like associated with a copying-unique function, a transmission/reception specification setting button for changing to a setting window having setting items and the like for a facsimile or Internet facsimile, a box specification setting button for changing to a setting window having setting items associated with, e.g., a box function of storing, in the memory of the apparatus, scanned image data or print data transmitted from a host computer serving as an information processing apparatus, and a destination cover sheet setting button for registering in advance the transmission destination of the above-mentioned facsimile or Internet facsimile. The user mode window also has a close button 1302 for closing the window of FIG. 8 and changing to a previous window.

(Common Specification Settings)

Figure 9:
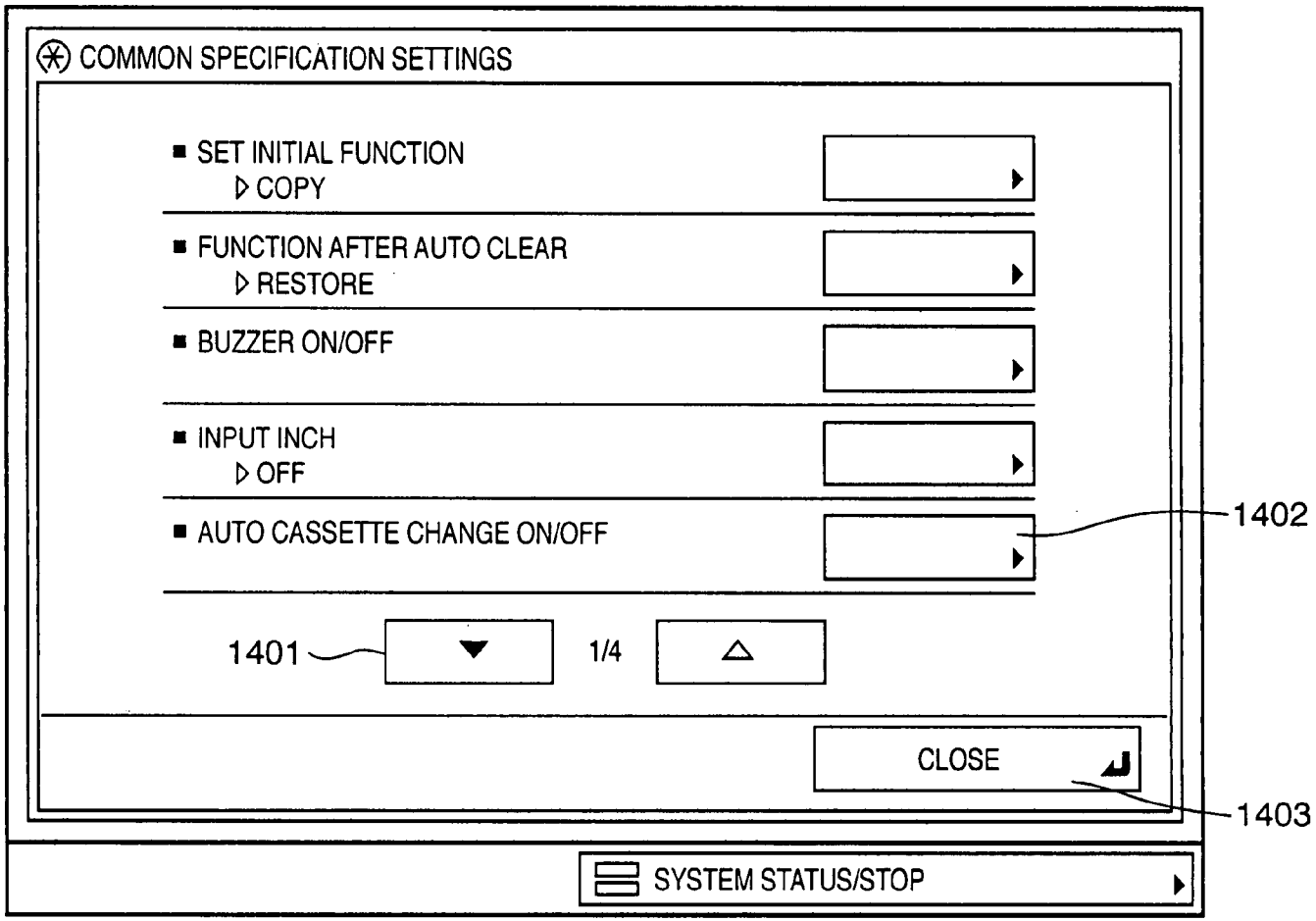
FIG. 9 is a view showing a common specification setting window (1/4)

FIG. 9 is a view showing a common specification setting window displayed on the liquid crystal screen of the operation section 150 in response to the click of the common specification setting button 1301 in the user mode window shown in FIG. 8.

The common specification setting window displays buttons and the like for selecting setting items associated with the whole apparatus regardless of copying, printer, box, and facsimile functions. One window displays buttons corresponding to setting items of five types (in FIG. 9, "initial function setting button", "function button after auto clear", "buzzer ON/OFF button", "inch input button", and "auto cassette change ON/OFF button 1402"). To select a setting item button other than currently displayed buttons, a next window selection button 1401 is selected. A display "1/4" on the right to the next window selection button 1401 means that four windows exist for common specification settings and the first window is currently displayed. The common specification setting window also has a close button 1403 for closing the window and changing to a window before the common specification setting window, similar to the description of FIG. 8.

Figure 10:
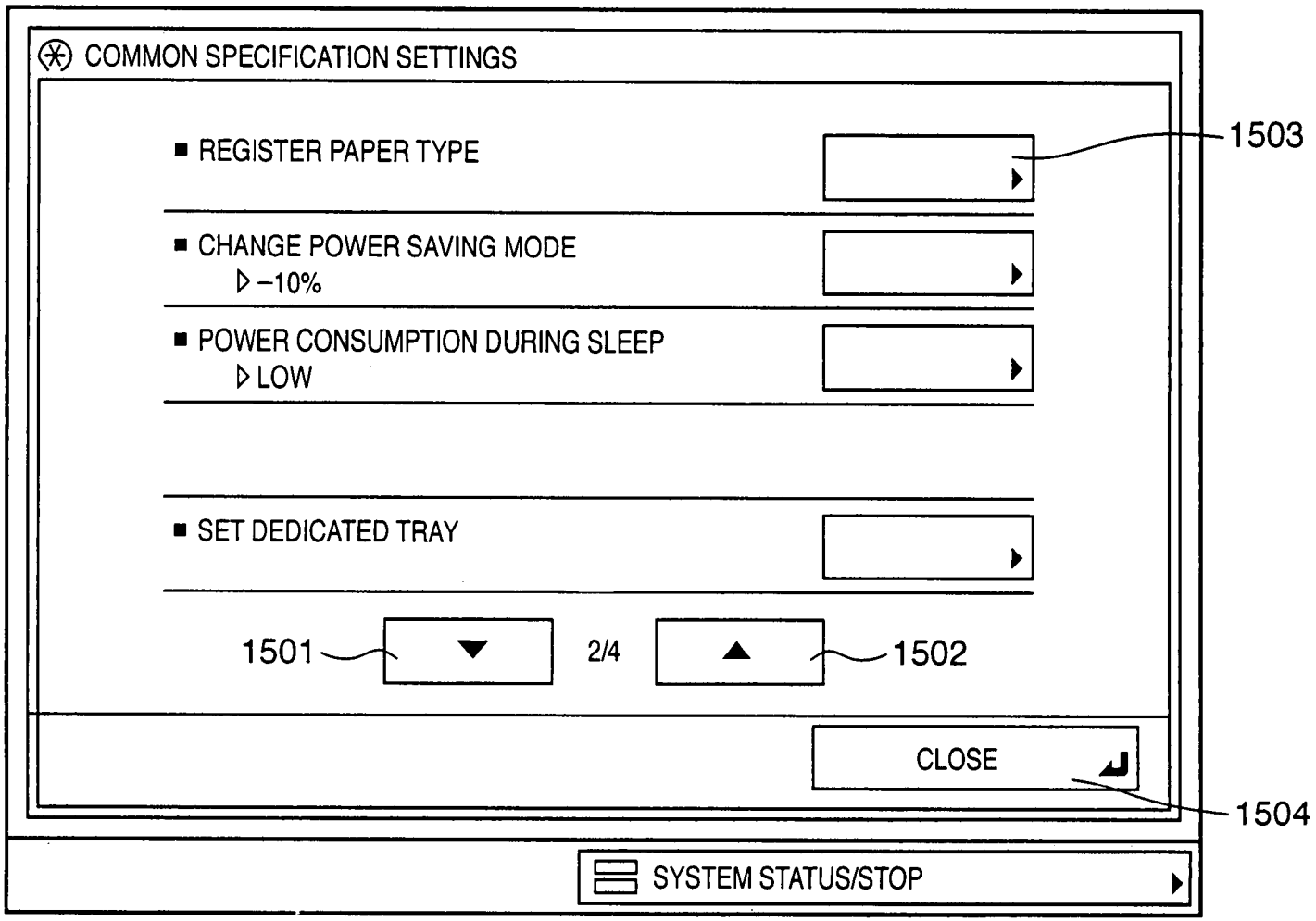
FIG. 10 is a view showing a common specification setting window (2/4)

FIG. 10 is a view showing the second common specification setting window displayed on the liquid crystal screen of the operation section 150 in response to the click of the next window selection button 1401 in the common specification setting window shown in FIG. 9.

The common specification setting window in FIG. 10 has a "paper type registration button" 1503 for registering a paper type (plain paper, recycled paper, colored paper, OHP, index sheet, or the like) stored in each paper feed portion, a "power saving mode change button" for changing the power saving mode, a "sleep power consumption button" for setting power consumption during sleep, and when a plurality of discharge trays exist, a "dedicated tray setting button" for setting a discharge tray to which a paper sheet bearing an image is discharged for each job type (copying, box, print, facsimile, or the like). The common specification setting window also has a next window selection button 1501 serving as a button for displaying a window for displaying a button associated with the common specification setting items of the next window, similar to the next window setting button shown in FIG. 9, and a previous window selection button 1502 for displaying a previous window (the window of FIG. 9 for the window of FIG. 10). A display "2/4" on the right to the next window selection button 1501 means that four windows exist for common specification settings and the second window is currently displayed. The common specification setting window also has a close button 1504 for closing the window and changing to a window before the common specification setting window, similar to the description of FIG. 9.

(Designation of Auto Cassette Change)

Figure 11:
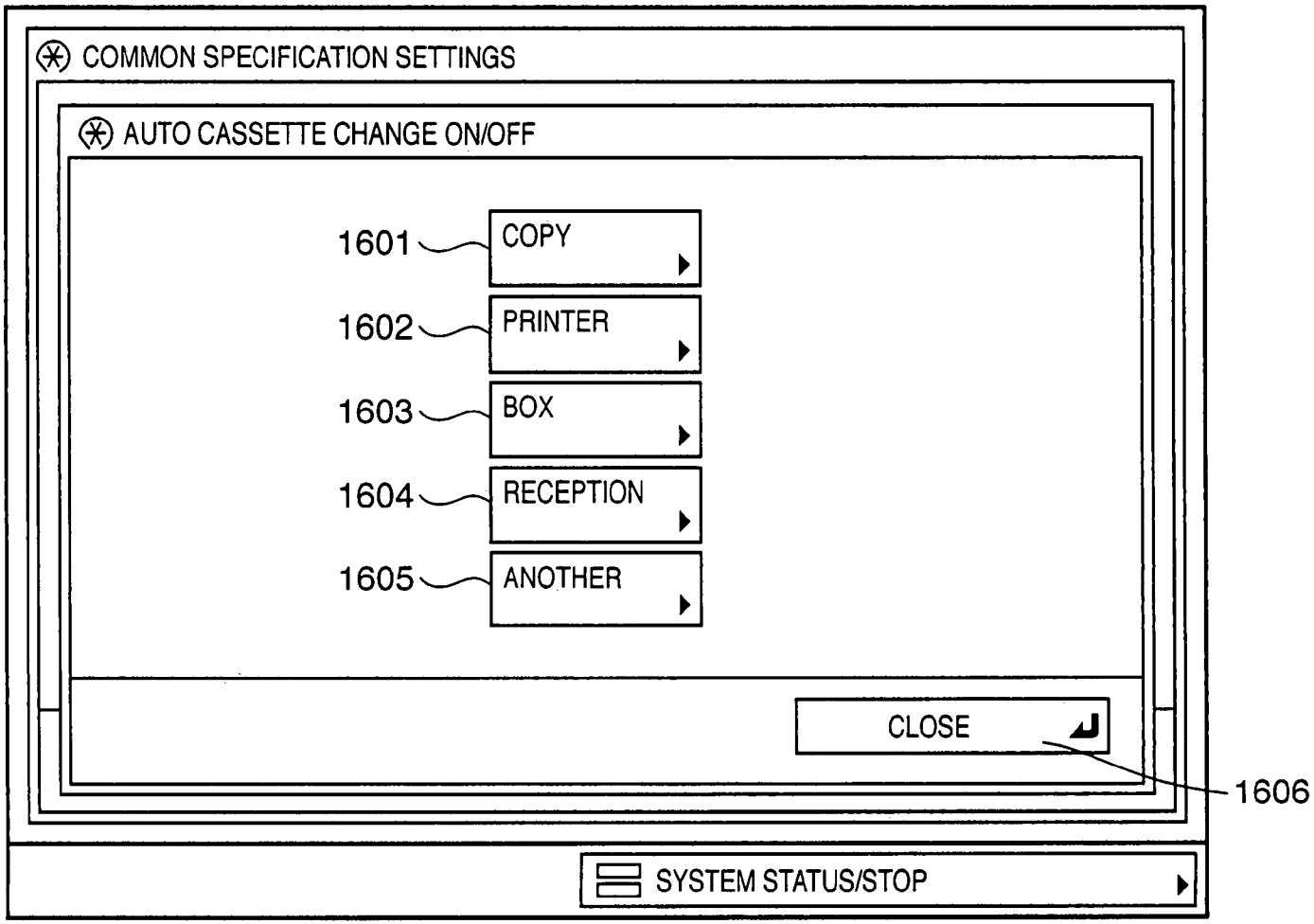
FIG. 11 is a view showing an auto cassette change ON/OFF window.

FIG. 11 is a view showing an auto cassette change ON/OFF window displayed on the liquid crystal screen of the operation section 150 in response to the click of the auto cassette change (ACC: =automatic paper feed portion change function described above) ON/OFF button 1402 in the common specification setting window (1/4) shown in FIG. 9. The auto cassette change ON/OFF window displays setting items for selecting a paper feed portion which can be automatically selected by the image forming apparatus for each job type (copying, printer, box, print, facsimile, or the like).

In the example of FIG. 11, buttons for respective job types are displayed. For example, this window has a copy button 1601 for setting a paper feed portion which can be automatically selected for the copying function, a printer button 1602 for setting a paper feed portion which can be automatically selected for the printing function, a box button 1603 for setting a paper feed portion which can be automatically selected for the box function, a reception button 1604 for setting a paper feed portion which can be automatically selected for the facsimile or Internet facsimile function, and another button 1605 for setting a paper feed portion which can be automatically selected for a job not included in the above-described job types. This window also has a close button 1606 for closing the current auto cassette change ON/OFF window and changing to the common specification setting window.

Figure 12:
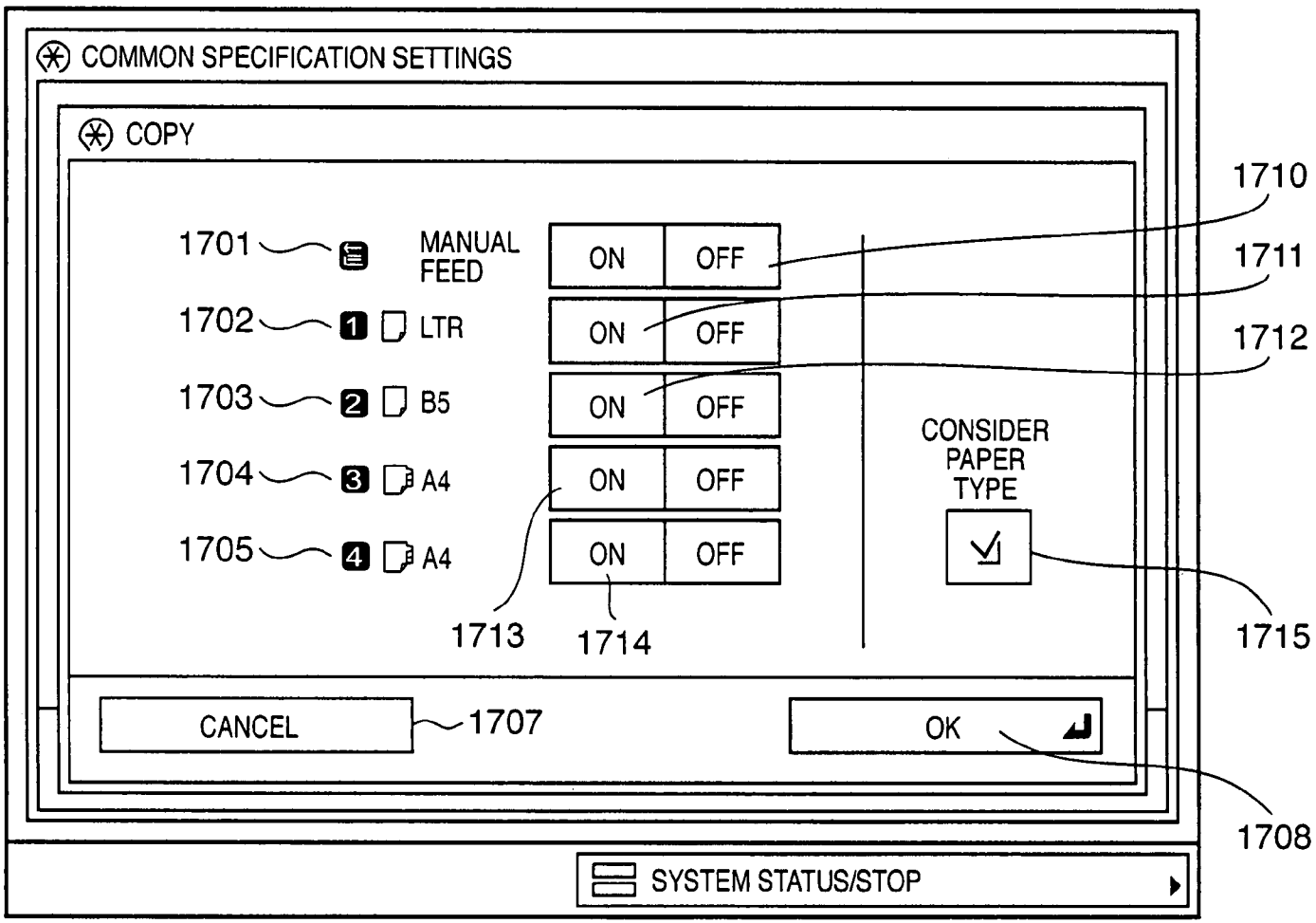
FIG. 12 is a view showing an auto cassette change ON/OFF & copying selection window.

FIG. 12 is a view showing a paper type registration window for a copying job displayed on the liquid crystal screen of the operation section 150 in response to the click of the copy button 1601 which allows the user to designate a paper feed portion selectable by the control section 110 for a copying job in the auto cassette change ON/OFF window shown in FIG. 11.

Icons 1701 to 1705 formed by symbols and characters represent set paper types (displayed by symbols) and paper sizes (displayed by standards) for the pullout cassettes 311, 312, 313, and 314 serving as paper storage portions in the printer section 300, and the manual paper feed portion 315 serving as a tray exposed outside the apparatus. The icon 1701 represents a paper type and paper size set for the manual paper feed portion 315. In the example of FIG. 12, no setting is registered.

The icon 1702 represents a paper type and paper size set for the cassette 311. In the example of FIG. 12, LTR-size plain paper is registered as a paper type. The icon 1703 represents a paper type and paper size set for the cassette 312. In the example of FIG. 12, B5-size plain paper is registered. The icon 1704 represents a paper type and paper size set for the cassette 313. In the example of FIG. 12, an A4-size index sheet is registered. The icon 1705 represents a paper type and paper size set for the cassette 314. In the example of FIG. 12, an A4-size index sheet is registered.

An ON/OFF button representing whether each paper feed portion is selected as an auto cassette change candidate (ON) or not (OFF) is displayed on the right of the display (each of the icons 1701 to 1705) representing a paper size and paper type set for the paper feed portion. For example, an OFF button 1710 is selected for the icon 1701 corresponding to the manual paper feed portion 315. This means that the manual paper feed portion 315 is not designated as an auto cassette change target for a copying job. Either the OFF or ON button is selected. When the OFF button is selected, no ON button is selected; when the ON button is selected, no OFF button is selected.

ON buttons 1711, 1712, 1713, and 1714 are selected for the icons 1702, 1703, 1704, and 1705 corresponding to the paper feed cassettes 311, 312, 313, and 314. This means that the paper feed portions (cassettes 311 to 314) are designated as auto cassette change targets for a copying job.

For jobs other than a copying job, the window of FIG. 12 is similarly displayed by clicking a button representing a job type in the window of FIG. 11. A cassette subjected to auto cassette change in print-out can be designated by the above-described procedures.

A "paper type consideration button" 1715 in FIG. 12 further allows the user to designate conditions in selecting a paper feed portion subjected to auto cassette change.

The "paper type consideration button (1715)" is used to set whether to consider the paper type in auto cassette change. Whether to consider the paper type in auto cassette change can be designated for each job type. When consideration of the paper type in auto cassette change is designated for a given job, whether not only paper sizes but also paper types coincide with each other (or compatible) is determined in auto cassette change. If both paper sizes and paper types coincide with each other, the paper feed portion is changed. For example, when plain paper sheets in a paper feed portion used by a given job run out, paper sheets equal in size to those in the paper feed portion are stored in another paper feed portion, but the paper type of this paper feed portion is not plain paper, no paper feed operation is done from this paper feed portion.

When consideration of the paper type in auto cassette change is not designated for a given job, no paper type is considered in auto cassette change. In this case, the paper feed portion is changed if paper sizes before and after cassette change coincide with each other.

When an OK button 1708 is clicked, a cassette subjected to auto cassette change and whether to consider the paper type, which are designated in the above manner, are designated by, for example, an identifier representing the cassette, and stored in the control section 110 for each job. A paper size is detected by a size sensor, and the detected size is stored in the control section 110 for each cassette. Alternatively, a paper size may be designated by the user for each cassette. When a cancel button 1707 is clicked, the window returns to a previous one without registering the above-mentioned settings in the window.

If paper sheets run out in printing and the auto cassette change function is to be performed, the control section 110 refers to, among others, the identifiers of cassettes serving as change destinations in accordance with the type of job in execution, and refers to the sizes of paper sheets set in cassettes corresponding to the identifiers. The control section 110 compares paper sizes corresponding to these paper feed portions with a paper size corresponding to the paper feed portion which runs out of paper sheets.

When consideration of the paper type is designated, the control section 110 determines whether a paper type corresponding to a paper feed portion determined to have the same paper size and a paper type corresponding to the paper feed portion which runs out of paper sheets are compatible. This sequence will be explained in more detail later. Note that the paper type is set as follows.

(Registration of Paper Type)

Figure 13:
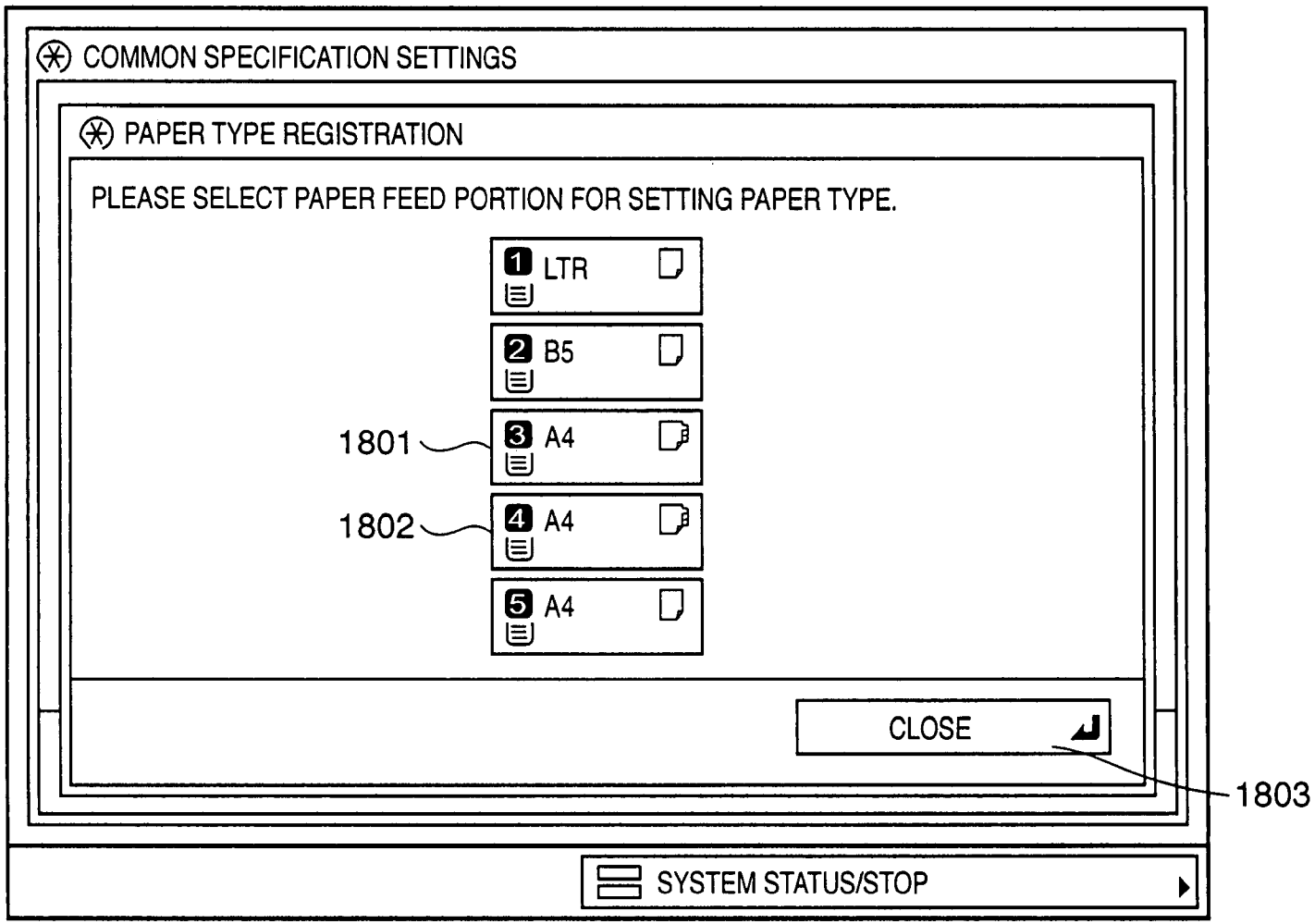
FIG. 13 is a view showing a paper type registration window.

FIG. 13 is a view showing a paper type registration window displayed on the liquid crystal screen of the operation section 150 in response to the click of the paper type registration button 1503 in the common specification setting window (2/4) shown in FIG. 10.

The paper type registration window displays buttons corresponding to the pullout cassettes 311, 312, 313, and 314 serving as paper storage portions in the printer section 300, and the manual paper feed portion 315 serving as a tray exposed outside the apparatus.

To register a paper type corresponding to the cassette 313, the user clicks a paper feed portion 3 button 1801. A window for setting the paper type of paper sheets in a paper feed portion corresponding to the cassette 313 is displayed in response to the click of the button 1801. To register a paper type corresponding to the cassette 314, the user clicks a paper feed portion 4 button 1802. A window for setting the paper type of paper sheets in a paper feed portion corresponding to the cassette 314 is displayed in response to this operation. This also applies to the remaining paper feed portions.

Each button represents the paper size and paper type of paper sheets set in a corresponding paper feed portion. For example, paper sheets with a paper size "LTR" and a paper type "plain paper" are set in the cassette 311. Paper sheets with a paper size "B5" and a paper type "plain paper" are set in the cassette 312. Paper sheets with a paper size "A4" and a paper type "index sheet" are set in the cassette 313. Paper sheets with a paper size "A4" and a paper type "index sheet" are set in the cassette 314.

When a button 1803 for closing the current paper type registration window is clicked, the window of FIG. 13 returns to a previous window, or, the common specification setting window.

Figure 14:
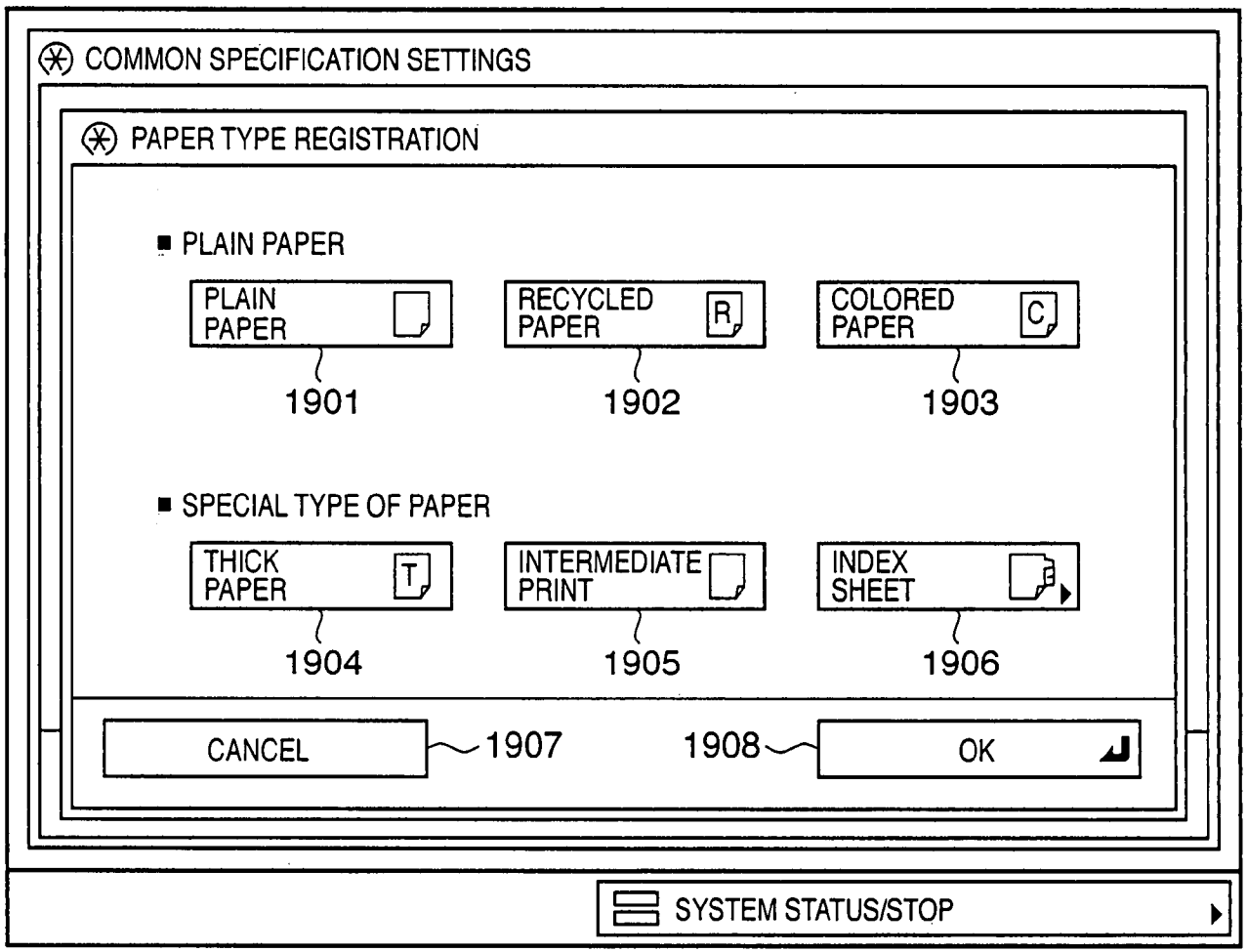
FIG. 14 is a view showing the second paper type registration window.

FIG. 14 is a view showing a paper type registration window displayed on the liquid crystal screen of the operation section 150 in response to the click of the paper feed portion 3 button 1801 for registering a paper type corresponding to the cassette 313 in the paper type registration window shown in FIG. 13. This also applies to the remaining cassettes or trays.

The paper type registration window displays buttons corresponding to registerable paper types in order to register a paper type corresponding to the cassette 313. Any one of plain paper (1901), recycled paper (1902), colored paper (1903), and an index sheet 1906 can be selected by clicking any button. The plain paper, recycled paper, and colored paper are recognized as plain paper for whether "to consider the paper type" in auto cassette change. That is, these paper sheets are determined as compatible ones in auto cassette change between these types. When the paper type consideration button 1715 shown in FIG. 12 is ON, the control section 110 can change a paper feed portion which runs out of paper sheets (auto cassette change) even if the paper type changes such that plain paper changes to recycled paper or recycled paper changes to colored paper.

As special types of paper, paper types such as thick paper 1904, intermediate print 1905, and the index sheet 1906 can also be registered. For these special types of paper, a paper feed portion which runs out of paper sheets is not changed between different paper types. That is, auto paper feed portion change is not executed between different paper types, such as between thick paper and plain paper, recycled paper and intermediate print, or index sheet and thick paper. Auto paper feed portion change is done between paper sheets of the same type, for example, between thick paper and thick paper, intermediate print and intermediate print, and index sheet and index sheet.

In FIG. 14, the user registers the paper type of a paper feed portion selected in FIG. 13 by selecting the buttons 1901 to 1906 representing paper types. To register the selected paper type (i.e., store it in the control section 110 for each paper feed portion), the user selects an OK button 1908. To return to a previous window without any registration, the user selects a cancel button 1907.

The index sheet takes various division numbers (index numbers) even for the same size. When the index sheet is selected, its division number is also set.

Figure 15:
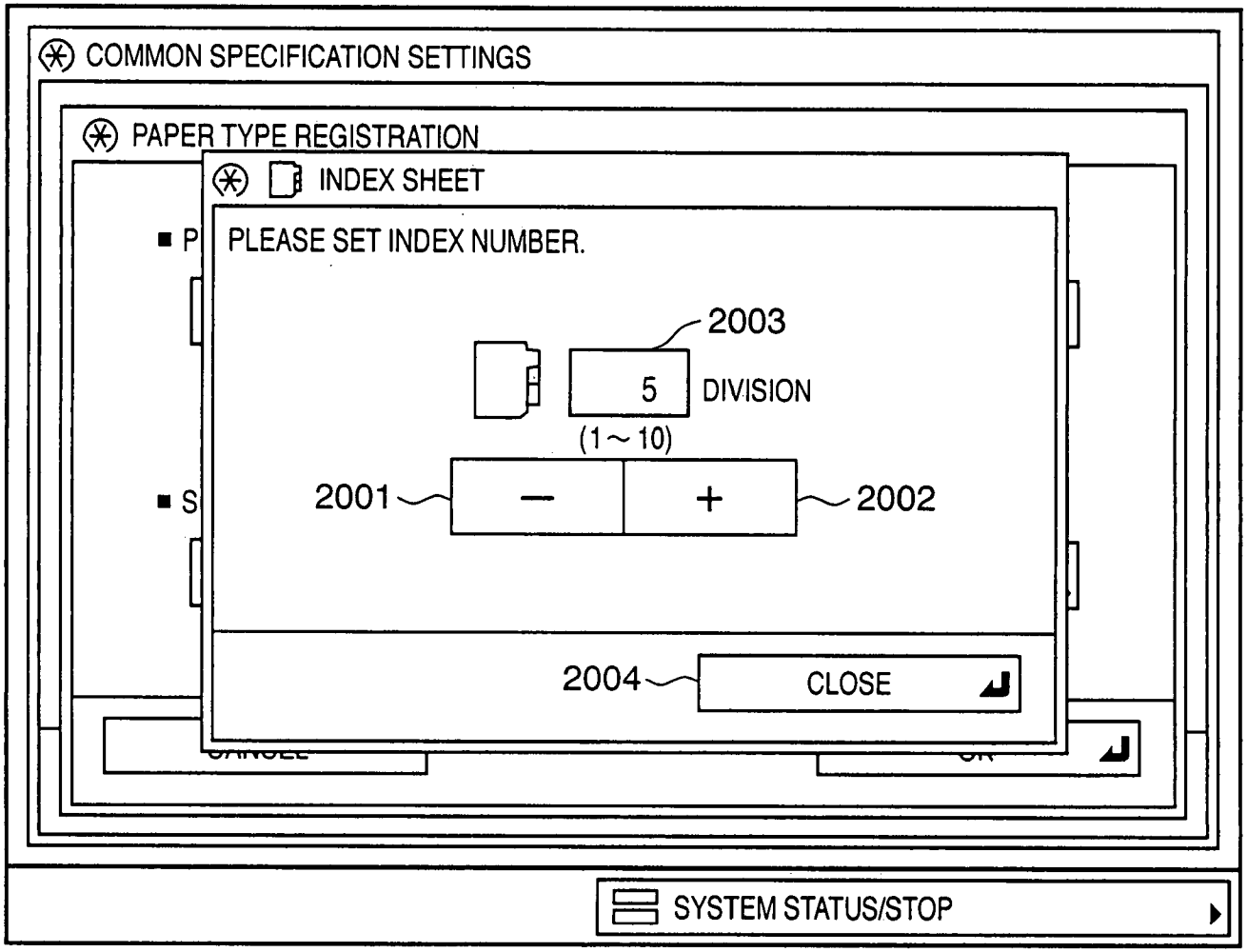
FIG. 15 is a view showing a paper type registration window and index sheet setting.

FIG. 15 is a view showing an index sheet setting window displayed on the liquid crystal screen of the operation section 150 in response to the click of the index sheet button 1906 in the paper type registration window shown in FIG. 14.

An index sheet has an index portion on a tab, and the index portion extends from a normal paper size to allow chaptering of a paper bundle. Several division numbers can be set for the index portion, and the division number can be set in the index number setting window for the index sheet in FIG. 15. In FIG. 15, the division number is 5, as displayed in a display window 2003. This division number can be set from a minimum of 1 to a maximum of 10. A + button 2002 is selected to increase the division number, and a – button 2001 is selected to decrease the division number. The maximum value of the division number is not limited to this. When a button 2004 is clicked, designation of the division number (index number) ends, and the current window returns to the paper type registration window.

The means for setting whether to enable paper feed portion change for each paper feed portion according to the present invention, the means for setting a paper type for each paper feed portion, and the means for setting an index number when the paper type is an index sheet have been described with reference to FIGS. 8 to 15.

Parameters registered in the control section 110 by the above operations and the sensor of the image forming apparatus are as follows.

(1) Setting of a paper feed portion subjected to auto cassette change for each job type
(2) Designation of whether to consider the paper type in auto cassette change for each job type
(3) Paper size for each paper feed portion
(4) Paper type for each paper feed portion
(5) Division number for each paper feed portion when the paper type is an index sheet Other parameters can also be set and read by the sensor. In FIG. 16 to be described later, these parameters are referred to.

<Automatic Paper Feed Portion Change Sequence>

The sequence of an automatic paper feed portion change function (auto cassette change function) by the image forming apparatus according to the embodiment will be explained with reference to FIGS. 16A and 16B.

As shown in FIG. 6, the control section 110 and printer section 300 exchange paper feed/delivery control commands. As shown in FIG. 6, the control section 110 notifies the printer section 300 which paper feed portion is to feed a paper sheet when the control section 110 issues the printing execution request 9003 to the printer section 300. This notification is sent by determining a paper feed portion for use by the control section 110 in accordance with a paper size and paper type designated by the operation panel 150 or a host computer, and notifying the printer section 300 of the determined paper feed portion. When no paper sheet exists in the notified paper feed portion, the printer section 300 notifies the control section 110 of the paper feed result status 9004 as a "no paper sheet" error. FIGS. 16A and 16B show a sequence performed by the control section 110 which has received the "no paper sheet" error.

Figure 16A:
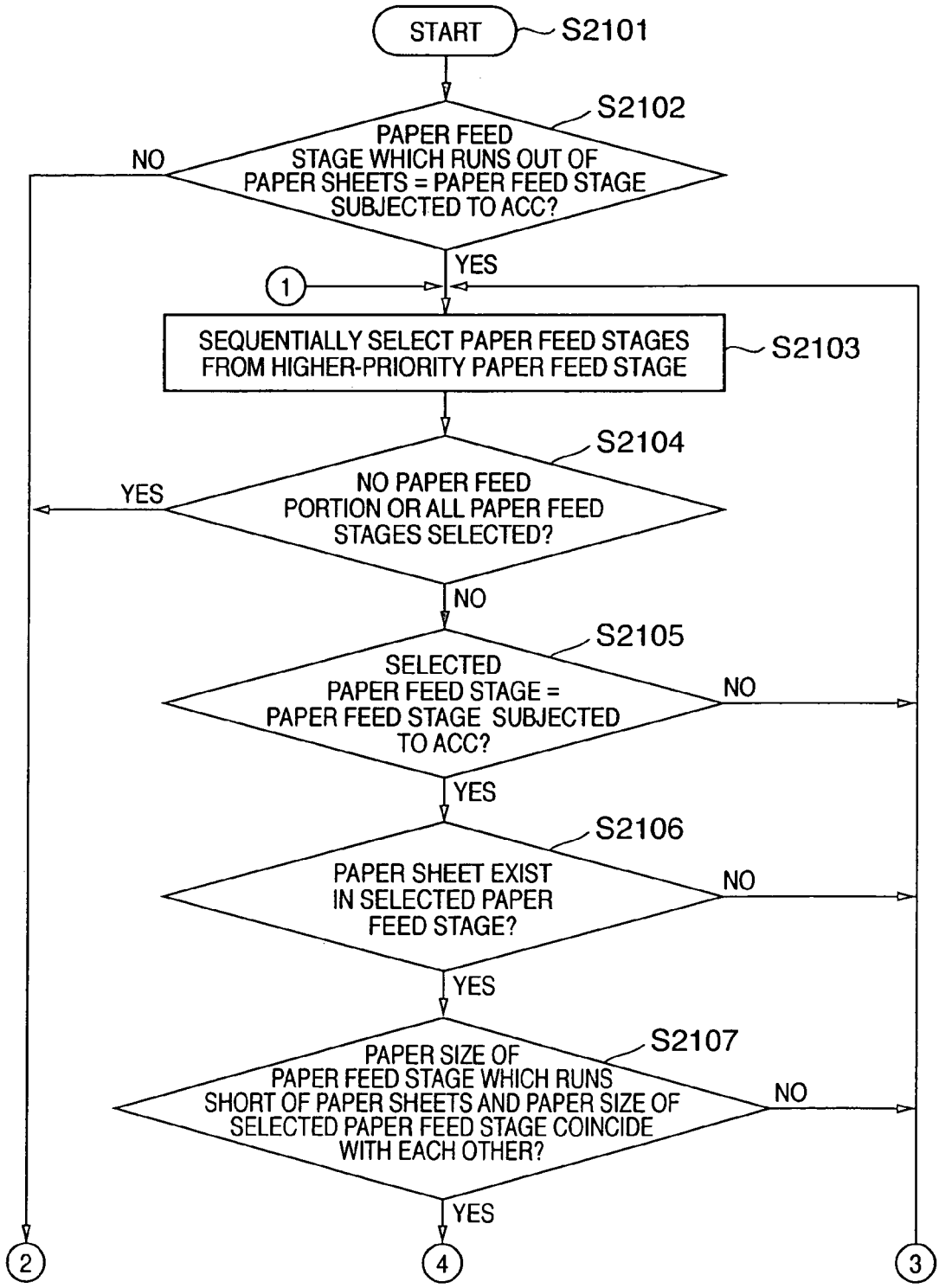
FIGS. 16A and 16B are flow charts showing the operation of the control section (controller) 110 according to the present invention.
Figure 16B:
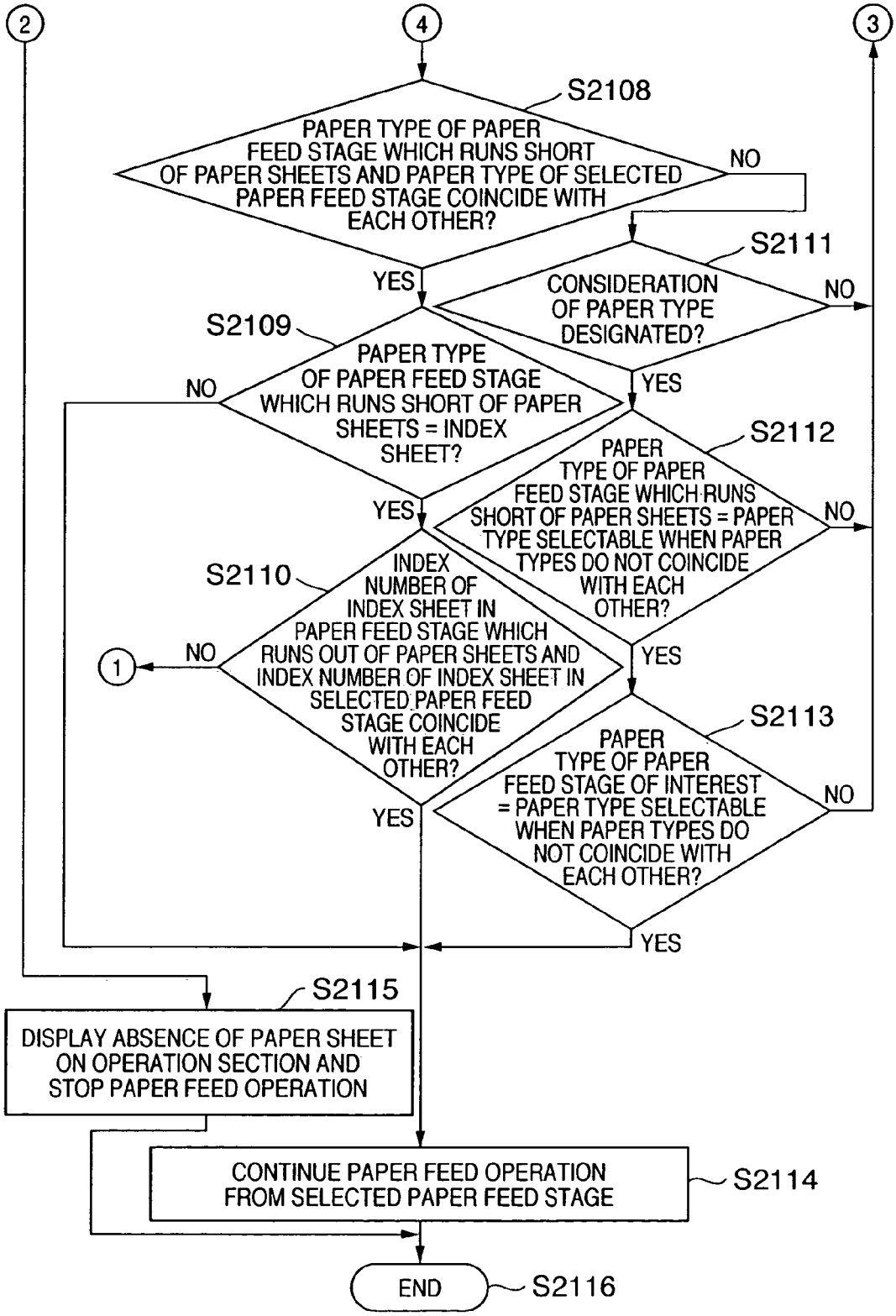

In FIGS. 16A and 16B, the control section 110 which has notified the printer engine of a given paper feed portion to try printing and has received the "no paper sheet" error from the printer engine executes the processing from step S2102.

In step S2102, the control section 110 determines whether the current paper feed portion which runs out of paper sheets is a paper feed portion subjected to auto cassette change (ACC) designated in the window of FIG. 12. This determination is done by referring to the parameter (1). If YES in step S2102, the flow advances to step S2103; if NO, to step S2115.

For control of specifying a paper feed portion subjected to auto cassette change, the embodiment defines the priority order of paper feed portions, and paper feed portion selection processing is performed in accordance with the priority order. The criterion of determining the priority order is based on, e.g., a paper feed portion with a short convey path or a paper feed portion with a large paper feed capacity, but the present invention is not limited to this. In the embodiment, priorities are given to the cassettes 311, 312, 313, and 314 and manual paper feed portion 315 serving as paper feed portions of the printer section 300 sequentially from a paper feed portion with a shorter convey path to the transfer portion 325. The priority order of paper feed portions in the printer section 300 shown in FIG. 2 is an order of the cassettes 311, 312, 313, and 314 and manual paper feed portion 315.

In step S2103, the control section 110 selects a paper feed portion having a higher priority among the paper feed portions on the basis of a predetermined priority order.

In step S2104, the control section 110 determines whether no other paper feed portion exists except a paper feed portion which runs out of paper sheets in selecting a paper feed portion in accordance with the priority order, or whether all paper feed portions have already been selected. If no other paper feed portion exists or all paper feed portions have already been selected, the flow advances to step S2115. If NO in step S2104, the flow advances to step S2105.

In step S2105, the control section 110 determines whether the selected paper feed portion is a paper feed portion subjected to auto cassette change (ACC) designated in FIG. 12. This determination is done on the basis of whether the paper feed portion of interest is set in the parameter (1). If YES in step S2105, the flow advances to step S2106; if NO, the flow returns to step S2103 to select a paper feed portion having the next priority.

In step S2106, the control section 110 determines whether paper sheets exist in the selected paper feed portion. If YES in step S2106, the flow advances to step S2107; if NO, the flow returns to step S2103 to select a paper feed portion having the next priority.

In step S2107, the control section 110 determines whether the size of paper sheets stored in the paper feed portion which runs out of paper sheets coincides with the size of paper sheets stored in the selected paper feed portion. If YES in step S2107, the flow advances to step S2108; if NO, the flow returns to step S2103 to select a paper feed portion having the next priority.

In step S2108, the control section 110 determines whether the paper type of the paper feed portion which runs out of paper sheets coincides with that of the selected paper feed portion. The paper type is the paper type of each paper feed portion that is registered in the paper type registration windows shown in FIGS. 13 and 14. If YES in step S2108, the flow advances to step S2109; if NO, the flow advances to step S2111.

In step S2109, the control section 110 determines whether the paper type of the paper feed portion which runs out of paper sheets and that of the selected paper feed portion are an index sheet. If YES in step S2109, the flow advances to step S2110; if NO, the flow advances to step S2114.

If the paper type is an index sheet, the control section 110 determines in step S2110 whether the index number of the index sheet in the paper feed portion which runs out of paper sheets and that of the index sheet in the selected paper feed portion coincide with each other. The determined index number is based on registration of the index number shown in FIG. 15. If YES in step S2110, the flow advances to step S2114; if NO, the flow returns to step S2103 to select a paper feed portion having the next priority.

In step S2111 to which the flow advances when the paper types are determined in step S2108 not to coincide with each other, the control section 110 determines for the current job whether consideration of the paper type has been designated. Designation of considering the paper type is set by the "paper type consideration button 1715" shown in FIG. 12. If YES in step S2111, the flow advances to step S2112; if NO, the flow returns to step S2103 to select a paper feed portion having the next priority.

In step S2112, the control section 110 determines whether the paper type of the paper feed portion which runs out of paper sheets is a paper type selectable when paper types do not coincide with each other. The paper type selectable even when paper types do not coincide with each other includes plain paper, recycled paper, and colored paper described with reference to FIG. 14. If YES in step S2112, the flow advances to step S2113; if NO, the flow returns to step S2103 to select a paper feed portion having the next priority.

In step S2113, the control section 110 determines whether the paper type of the selected paper feed portion is a paper type selectable when paper types do not coincide with each other. The paper type selectable even when paper types do not coincide with each other includes plain paper, recycled paper, and colored paper described with reference to FIG. 14. If YES in step S2113, the flow advances to step S2114; if NO, the flow returns to step S2103.

In step S2114, the control section 110 determines that paper feed operation can continue from the selected paper feed portion, and thus continues paper feed operation from the selected paper feed portion. The flow advances to step S2116 and ends.

In step S2115, the control section 110 determines that paper feed operation cannot continue from a paper feed portion other than the paper feed portion which runs out of paper sheets. The control section 110 stops paper feed operation, displays a window representing the absence of paper sheets on the operation section 150, and ends the flow.

Figure 17:
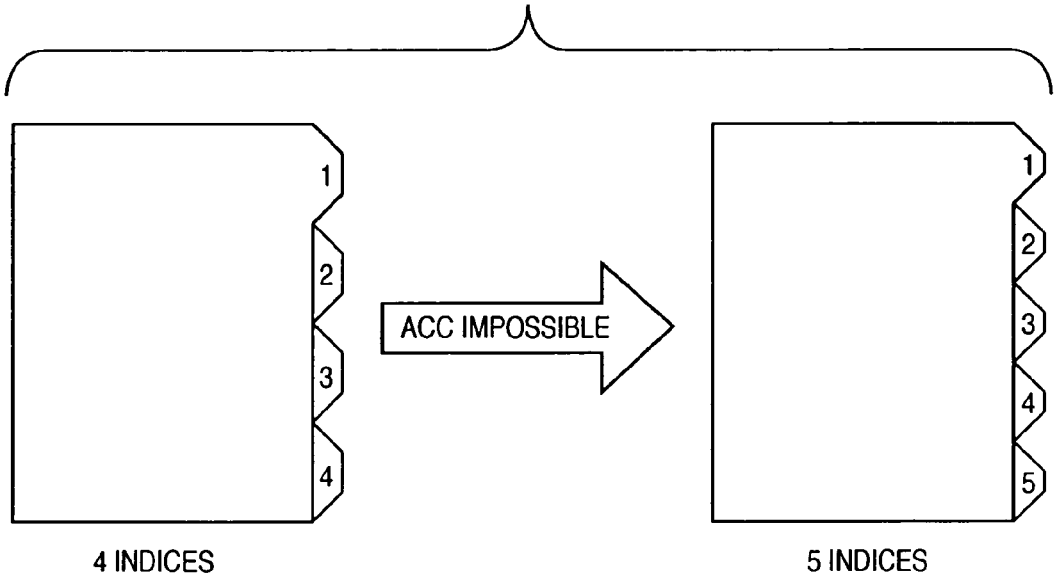
FIG. 17 is a view for explaining ACC for paper sheets with different index numbers.
Figure 18:
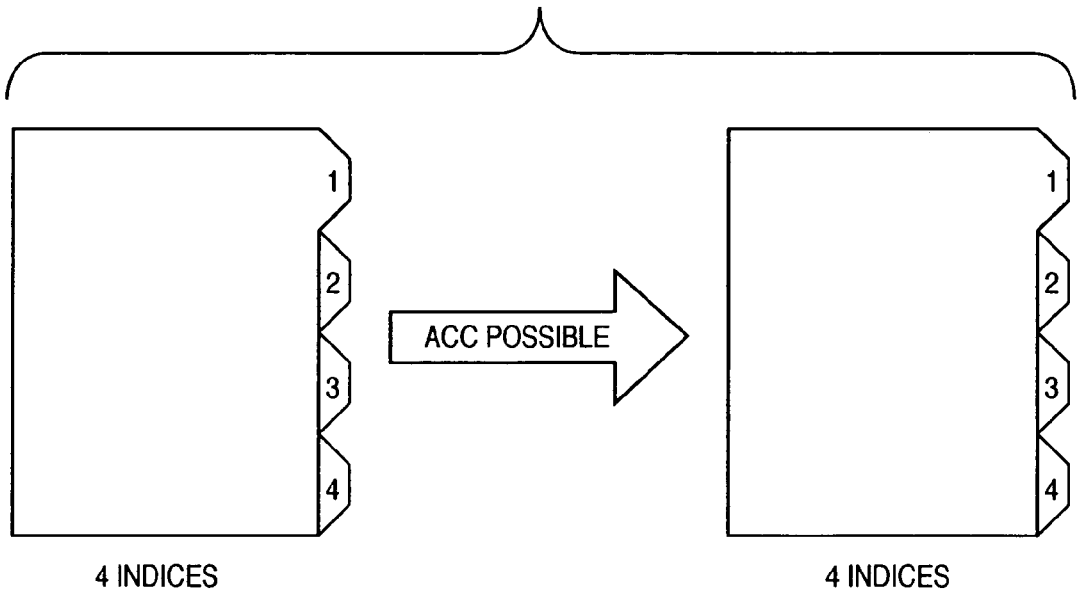
FIG. 18 is a view for explaining ACC for paper sheets with the same index number.

FIG. 17 shows an example when no auto cassette change is executed by the above sequence for an index sheet. FIG. 18 shows an example when auto cassette change is executed.

By the sequence shown in FIGS. 16A and 16B, even an image forming apparatus having an auto cassette change function of changing a predetermined paper feed portion to another one and continuing printing when the predetermined paper feed portion runs out of paper sheets during printing (which includes not only printing operation in a printer, but also printing operation in an image forming apparatus having a printing function such as a copying apparatus or facsimile apparatus) does not execute automatic paper feed portion change if not only paper sizes but also index numbers do not coincide with each other for an index sheet. This can prevent output of a printed material not intended by the user. In other words, this can prevent selecting paper sheets with different index numbers such as an index sheet with an index number of 4 and an index sheet with an index number of 5, as identical paper sheets subjected to auto cassette change.

In the embodiment, a paper feed portion subjected to auto cassette change is designated in advance. The present invention is also effective in an image forming apparatus in which no paper feed portion subjected to auto cassette change can be designated but all cassettes or trays are subjected to auto cassette change.

In the embodiment, auto cassette change is executed when a paper feed portion runs out of paper sheets. The present invention is, however, not limited to this.

As described above, the present invention can shorten the operation stop time and increase the apparatus availability and printing processing productivity by successively using a plurality of paper feed portions. At the same time, when a plurality of paper feed portions store index sheets but their types do not coincide with each other, auto paper feed portion change processing is controlled not to be performed. This can prevent any output result not intended by the user.

First Modification to Embodiment

Index sheets are different not only in size and division number, but also in the shape of the index portion. Also in this case, auto cassette change is preferably inhibited. In FIG. 15, only the index division number is set. Further, other differences such as the shape of the index portion are set, which can increase the auto cassette change precision of index sheets. In this setting, the user can assign and register a type number or the like for causing the control section 110 to recognize, among others, the shape of the index sheet. In this case, the type number means an index representing that auto cassette change can be performed if type numbers coincide with each other. Instead of step S2110 in FIG. 16, or when the determination result of step S2110 is "YES", the type numbers of index sheets set in a paper feed portion serving as the change source of auto cassette change and a (selected) paper feed portion serving as the change destination are compared with each other. When these type numbers coincide with each other, step S2114 is executed; otherwise, the flow returns to step S2103.

With this processing, whether the numbers of index portions as well as shapes or the like coincide with each other, can be determined. If the types of index sheets do not coincide with each other, the auto cassette change function can be disabled.

Second Modification to Embodiment

In the embodiment, the user sets the paper type, index number, and the like. The present invention can, however, also be practiced when these parameters are detected by sensors and automatically set without any labor of the user.

Other Embodiments

Note that the present invention can be applied to an apparatus comprising a single device or to system constituted by a plurality of devices.

Furthermore, the invention can be implemented by supplying a software program (shown in FIG. 16), which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code itself installed in the computer also implements the present invention. In other words, the claims of the present invention also cover a computer program for the purpose of implementing the functions of the present invention.

In this case, so long as the system or apparatus has the functions of the program, the program may be executed in any form, e.g., as object code, a program executed by an interpreter, or scrip data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

Further, it is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Furthermore, besides the case where the aforesaid functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus having a plurality of paper feed units capable of setting index sheets, comprising:

a storage section which stores size information, type information and index number information indicating the number of index sheets per set of paper sheets set in each paper unit in a case where index sheets are set in the plurality of paper feed units;

a determining section which determines whether index number information of a first paper feed unit coincides with that of a second paper feed unit or that of a third paper feed unit;

a first control section which performs processing of automatically changing the paper feed unit to be used from the first paper feed unit to the second paper feed unit and does not perform processing of automatically changing the paper feed unit from the first paper feed unit to the third paper feed unit in a case where paper sheets are set in the first paper feed unit are run out, the type information of the first paper unit indicates an index sheet, and all of the elements of a first predetermined condition are satisfied; and a second control section which performs processing of automatically changing the paper feed unit to be used from the first paper feed unit to the second paper feed unit and does not perform processing of automatically changing the paper feed unit from the first paper feed unit to the third paper feed unit in a case where paper sheets set in the first paper feed unit are run out, the type information of the first paper feed unit does not indicate the index sheet, and all of the elements of a second predetermined condition are satisfied, wherein the first predetermined condition is that the size information, type information and the index number information of the first paper feed unit coincide with those of the second paper feed unit, and at least one of the size information, the type information and the index number information of the first paper feed unit do not coincide with those of the third paper feed unit, and the second predetermined condition is that the size information and type information of the first paper feed unit coincide with those of the second paper feed unit, and at least one of the size information and type information of the first paper feed unit do not coincide with those of the third paper feed unit.

2. The apparatus according to claim 1, wherein said storage section stores index shape information indicating a shape of the index portion of the paper sheet set in the paper feed units, wherein said first control section performs processing of automatically changing the paper feed unit to be used from the first paper feed unit to the second paper feed unit in a case where the index shape information of the first paper feed unit coincides with that of the second paper feed unit, and does not perform processing of automatically changing the paper feed unit from the first paper feed unit to the third paper feed unit in a case where the index shape information of the first paper feed unit does not coincide with those of the third paper feed unit.

3. The apparatus according to claim 1, wherein the image forming apparatus further comprises a unit change setting section which determines whether to automatically enable paper feed unit change processing for each of the plurality of paper feed units and sets a unit change setting in accordance with a predetermined condition, wherein the predetermined condition is that the unit change setting section sets the unit change setting to automatically enable change processing for the second paper feed unit.

4. A method of controlling an image forming apparatus having a plurality of paper feed unit capable of setting index sheets, comprising:

a storage step of storing paper size information, type information and index number information indicating the number of index sheets per set paper sheet set in each paper feed unit in a case where the index sheets are set in the plurality of paper feed units;

a determining step section which determines that index number information of a first paper feed unit coincides with that of a second paper feed unit or that of a third paper feed unit:

a first control step of performing processing of automatically changing the paper feed unit to be used from the first paper feed unit to the second paper feed unit and does not perform processing of automatically changing the paper feed unit from the first paper feed unit to the third paper feed unit in a case where paper sheets set in the first paper feed unit are run out, the type information of the first paper unit indicates an index sheet, and all of the elements of a predetermined condition are satisfied, a second control step of performing processing of automatically changing the paper feed unit to be used from the first paper feed unit to the second paper feed unit and does not perform processing of automatically changing the paper feed unit from the first paper feed unit to the third paper feed unit in a case where paper sheets set in the first paper feed unit are run out. the type information of the first paper feed unit does not indicate the index sheet, and all of the elements of a second predetermined condition are satisfied, wherein the first predetermined condition is that the size information, type information, and index number information of the first paper feed unit coincide with those of the second paper feed unit, and at least one of the size information, type information, and index number information of the first paper feed unit do not coincide with those of the third paper feed unit, and the second predetermined condition is that the size information and the type information of the first paper feed unit coincide with those of the second paper feed unit, and at least one of the size information and the type information of the first paper feed unit do not coincide with those of the third paper feed unit.

5. The method according to claim 4, wherein said storage section stores index shape information indicating a shape of the index portion of the paper sheet set in the paper feed units, wherein said first control step performs processing of automatically changing the paper feed unit to be used from the first paper feed unit to the second paper feed unit in a case where the index shape information of the first paper feed unit coincides with that of the second paper feed unit, and does not perform processing of automatically changing the paper feed unit from the first paper feed unit to the third paper feed unit in a case where the index shape information of the first paper feed unit do not coincide with those of the third paper feed unit.

6. The method according to claim 4, wherein the control method further comprises a unit change setting step of determining whether to automatically enable paper feed unit change processing for each of the plurality of paper feed units and sets a unit change setting in accordance with a predetermined condition, wherein the predetermined condition is that the unit change setting section sets the unit change setting to automatically enable change processing for the second paper feed unit.

* * * * *

UNITED STATES PATENT AND TRADEMARK OFFICE

CERTIFICATE OF CORRECTION

PATENT NO. : 7,377,506 B2
APPLICATION NO. : 10/765400
DATED : May 27, 2008
INVENTOR(S) : Miyajima It is certified that error appears in the above-identified patent and that said Letters Patent is hereby corrected as shown below:

COLUMN 5:
Line 19, "of" should be deleted.

COLUMN 12:
Line 13, "(or" should read --(or are--.

COLUMN 18:
Line 10, "scrip" should read --script--.

COLUMN 19:
Line 11, "are" (first occurrence) should be deleted.
Line 64, "unit" should read --units--.

COLUMN 20:
Line 15, "paper" should read --paper feed--.
Line 17, "satisfied," should read --satisfied;--.
Line 24, "out." should read --out,--.
Line 54, "do" should read --does--.
Line 54, "those" should read --that--.

Signed and Sealed this

Ninth Day of December, 2008

JON W. DUDAS
*Director of the United States Patent and Trademark Office*